US007170219B2

(12) United States Patent
Hori et al.

(10) Patent No.: US 7,170,219 B2
(45) Date of Patent: Jan. 30, 2007

(54) SPARK PLUG WITH MULTIPLE GROUND ELECTRODES

(75) Inventors: Tsunenobu Hori, Susono (JP); Shinichi Okabe, Aichi-ken (JP)

(73) Assignees: Denso Corporation (JP); Nippon Soken, Inc. (JP)

( * ) Notice: Subject to any disclaimer, the term of this patent is extended or adjusted under 35 U.S.C. 154(b) by 0 days.

(21) Appl. No.: 11/197,747

(22) Filed: Aug. 5, 2005

(65) Prior Publication Data

US 2006/0028107 A1 Feb. 9, 2006

(30) Foreign Application Priority Data

Aug. 6, 2004 (JP) ..... 2004-231138

(51) Int. Cl.
*H01J 13/20* (2006.01)

(52) U.S. Cl. ..... 313/141; 313/142

(58) Field of Classification Search ..... 313/141, 313/118

See application file for complete search history.

(56) References Cited

U.S. PATENT DOCUMENTS 6,229,253 B1 5/2001 Iwata et al.
6,316,868 B1 11/2001 Ishino et al.
2003/0085643 A1* 5/2003 Matsubara ..... 313/141
2004/0080252 A1* 4/2004 Ito et al. ..... 313/141
2005/0264153 A1* 12/2005 Hanashi ..... 313/141

FOREIGN PATENT DOCUMENTS

JP 2000-68032 3/2000
JP 2001-160475 6/2001

* cited by examiner

*Primary Examiner*—Ashok Patel
(74) *Attorney, Agent, or Firm*—Nixon & Vanderhye PC

(57) ABSTRACT

A spark plug according to the present invention includes a metal shell, an insulator, a cylindrical center electrode, a first ground electrode, and a second ground electrode. The first ground electrode is aligned with the center electrode in the axial direction of the center electrode to form a first spark gap, across which normal sparks are discharged when the insulator is not fouled with carbon. The second ground electrode is aligned with the center electrode in the radial direction of the center electrode to form a second spark gap, across which side sparks are discharged when the insulator is fouled with carbon. The spark plug has an improved structure where dimensional parameters A, T, B, C, L, D, and E are specified to be in suitable ranges that are determined through experimental investigation. The improved structure ensures a high ignition capability and a long service life of the spark plug.

23 Claims, 21 Drawing Sheets

SPARK PLUG WITH MULTIPLE GROUND ELECTRODES

CROSS-REFERENCE TO RELATED APPLICATION

This application claims priority from Japanese Patent Application No. 2004-231138, filed on Aug. 6, 2004, the content of which is hereby incorporated by reference into this application.

BACKGROUND OF THE INVENTION

1. Technical Field of the Invention

The present invention relates generally to spark plugs for use in internal combustion engines of automobiles and cogeneration systems.

More particularly, the invention relates to a spark plug with multiple ground electrodes, which has a high capability to ignite the air-fuel mixture (to be referred to as ignition capability hereinafter) and a long service life.

2. Description of the Related Art

FIG. 36 shows an existing spark plug 9 for use in an internal combustion engine of an automobile, which includes a tubular metal shell 94, an insulator 92, a cylindrical center electrode 93, a first ground electrode 951, and a pair of second ground electrodes 952.

(For example, Japanese Patent No. 3140006, an English equivalent of which is U.S. Pat. No. 6,229,253, discloses such a multiple ground electrodes spark plug.)

The tubular metal shell 94 has a threaded portion 940 for fitting the spark plug 9 into the combustion chamber of the engine.

The insulator 92 has a bore 921 formed therethrough and is fixed in the metal shell 94 such that an end 922 thereof protrudes from an end 941 of the metal shell 94.

The cylindrical center electrode 93 is secured in the bore 921 of the insulator 92 and has an end 931 that protrudes from the end 922 of the insulator 92.

The first ground electrode 951 has a base end joined to the end 941 of the metal shell 94 and a tip portion that faces the end 931 of the center electrode 93 through a first spark gap A in the axial direction of the center electrode 93.

Each of the second ground electrodes 952 has a base end joined to the end 941 of the metal shell 94 and a tip portion that faces the outer side surface of the center electrode 93 through a second spark gap G in the radial direction of the center electrode 93.

In such a spark plug 9, normal sparks are discharged across the first spark gap A in normal condition of the spark plug.

However, when the combustion temperature of the air-fuel mixture is low, the temperature on the outer surface of the insulator 92 will be accordingly low. As a result, carbon will deposit on the outer surface of the insulator 92, thus causing "carbon-fouling" of the insulator 92.

Generally, the carbon-fouling of an insulator in a spark plug causes the insulation resistance between a center electrode and a metal shell of the spark plug to be decreased, and even results in misfire of the engine.

However, in the spark plug 9, when the insulator 92 is fouled with carbon, instead of normal sparks, "side sparks" are discharged across the second spark gaps G, thereby burning off the carbon deposit on the outer surface of the insulator 92.

As a result, the outer surface of the insulator 92 is cleaned by the spark plug 9 itself, thus recovering the insulation resistance and ignition capability of the spark plug 9.

However, at the same time, side sparks may cause a "channeling problem" and wear on the outer side surface of the center electrode 93. The channeling problem here denotes a phenomenon in which the heat energy transferred from side sparks to the end 922 of the insulator 92 partially melts the insulator 92, thereby forming channels on the end 922 of the insulator 92.

Accordingly, it is required for the spark plug 9 to discharge side sparks only when the insulator 92 is fouled with carbon, so that the durability and ignition capability of the spark plug 9 can be secured.

However, when the spark plug 9 is used in a recent engine, which is of high-compression and lean-burn type and used in combination with a supercharger and an EGR (Exhaust Gas Recirculation) system, the flow speed in the proximity of the spark plug 9 is high. (Such an engine will be referred to as a high flow speed engine hereafter.)

The high flow speed will force normal sparks discharged in the first spark gap A of the spark plug 9 to deviate from the normal course (i.e., in the axial direction of the center electrode 93), thus increasing the required voltage of the spark plug 9 for discharging normal sparks.

As a result, even when the insulator 92 is not fouled with carbon, occurrence rate of side sparks will increase, so that formation of channels on the insulator 92 and wear on the outer side surface of the center electrode 93 can be facilitated, thus shortening the service life of the spark plug 9.

To solve the above problem, one may consider taking a countermeasure to decrease the required voltage of the spark plug 9 for discharging normal sparks, thereby reducing the occurrence rate of side sparks. However, at the same time, decreasing the required voltage for discharging normal sparks may cause the occurrence rate of side sparks to be decreased even when the insulator 92 is fouled with carbon, thus decreasing the self-clean capability of the spark plug 9.

SUMMARY OF THE INVENTION

The present invention has been made in view of the above-mentioned problem.

It is, therefore, a primary object of the present invention to provide a spark plug with multiple ground electrodes, which has a high ignition capability and a long service life.

According to the first aspect of the present invention, a spark plug S1 is provided which includes a tubular metal shell, an insulator, a cylindrical center electrode, a first ground electrode, and a second ground electrode.

The tubular metal shell has a threaded portion on an outer periphery thereof; the threaded portion has a size less than or equal to M14.

The insulator is fixed in the metal shell. The insulator has a bore formed therethrough and an end that protrudes from an end of the metal shell.

The cylindrical center electrode is secured in the bore of the insulator. The center electrode has an axis and an end that protrudes from the end of the insulator.

The first ground electrode has a base end joined to the end of the metal shell and a tip portion that faces the end of the center electrode through a first spark gap in the axial direction of the center electrode.

The second ground electrode has a base end joined to the end of the metal shell and a tip portion that faces the outer side surface of the center electrode through a second spark gap in the radial direction of the center electrode.

In the spark plug S1, the following dimensional parameters are specified.

A size A of the first spark gap, which is the minimum distance between the end of the center electrode and the tip portion of the first ground electrode in the axial direction of the center electrode, is in the range of 0.4 to 1.0 mm.

A wall thickness T of the insulator at the end of the insulator is in the range of 0.3 to 0.8 mm.

A distance B, which is the minimum distance between the insulator and the tip portion of the second ground electrode, is in the range of 0.2 to 0.9 mm.

A distance C, which is a distance between an edge of the tip portion of the second ground electrode and the inner edge of the end of the insulator in the axial direction of the center electrode, is in the range of −1.0 to 0.5 mm. The edge of the tip portion of the second ground electrode faces the end of the metal shell. The distance C takes a positive value when the edge of the tip portion of the second ground electrode is closer to the end of the center electrode than the inner edge of the end of the insulator in the axial direction of the center electrode.

Through specifying the ranges of parameters A, T, B, and C as above, a high ignition capability and a long service life of the spark plug S1 is ensured.

It is preferable that in the spark plug S1, the distance B is in the range of 0.2 mm to (A−0.05 mm).

According to the second aspect of the present invention, a spark plug S2 is provided which includes a tubular metal shell, an insulator, a cylindrical center electrode, a first ground electrode, and a second ground electrode.

The tubular metal shell has a threaded portion on an outer periphery thereof; the threaded portion has a size less than or equal to M14.

The insulator is fixed in the metal shell. The insulator has a bore formed therethrough and an end that protrudes from an end of the metal shell.

The cylindrical center electrode is secured in the bore of the insulator. The center electrode has an axis and an end that protrudes from the end of the insulator.

The first ground electrode has a base end joined to the end of the metal shell and a tip portion that faces the end of the center electrode through a first spark gap in the axial direction of the center electrode.

The second ground electrode has a base end joined to the end of the metal shell and a tip portion that faces the outer side surface of the center electrode through a second spark gap in the radial direction of the center electrode.

In the spark plug S2, the following dimensional parameters are specified.

A distance L, which is a distance between an inner edge of the base end of the second ground electrode and the axis of the center electrode in the radial direction of the center electrode, is less than or equal to 3.5 mm.

The wall thickness T of the insulator at the end of the insulator is in the range of 0.3 to 0.8 mm.

The distance B is in the range of 0.2 to 0.9 mm.

The distance C is in the range of −1.0 to 0.5 mm.

Through specifying the ranges of parameters L, T, B, and C as above, a high ignition capability and a long service life of the spark plug S2 is ensured.

It is preferable that in the spark plug S2, the size A of the first spark gap is in the range of 0.4 to 1.1 mm.

Further, it is preferable that in both the spark plugs S1 and S2, a distance D, which is a distance between the inner edge of the end of the metal shell and the outer surface of the insulator in the radial direction of the center electrode, is in the range of 0.6 to 1.6 mm.

It is also preferable that in both the spark plugs S1 and S2, the outer diameter E of the insulator at the end of the insulator is in the range of 2.1 to 3.9 mm.

It is also preferable that in both the spark plugs S1 and S2, at least one of the center electrode, the first ground electrode, and the second ground electrode includes a base member and a discharge member that is joined to the base member and is made of a noble metal or its alloy.

The discharge member is preferably made of a Pt-based alloy that includes Pt in an amount of not less than 50 weight percent and at least one additive selected from Ir, Rh, Ni, W, Pd, Ru, Os, Y, and $Y_2O_3$.

Otherwise, the discharge member is preferably made of an Ir-based alloy that includes Ir in an amount of not less than 50 weight percent and at least one additive selected from Pt, Rh, Ni, W, Pd, Ru, Os, Y, and $Y_2O_3$.

When the center electrode includes a base member and a discharge member, the discharge member has a length with a first end representing the end of the center electrode and a second end joined to the base member. It is preferable that a cross sectional area S1 of the discharge member, which is perpendicular to the lengthwise direction of the discharge member, is in the range of 0.1 to 0.8 $mm^2$; a distance F1 from the first end of the discharge member to the base member in the lengthwise direction of the discharge member is in the rang of 0.3 to 1.5 mm.

When the first ground electrode includes a base member and a discharge member, the discharge member has a length with a first end facing the end of the center electrode in the axial direction of the center electrode and a second end joined to the base member. It is preferable that a cross sectional area S2 of the discharge member, which is perpendicular to the lengthwise direction of the discharge member, is in the range of 0.1 to 0.8 $mm^2$; a distance F2 from the first end of the discharge member to the base member in the lengthwise direction of the discharge member is in the rang of 0.3 to 1.5 mm.

When the second ground electrode includes a base member and a discharge member, the discharge member has a length with a first end facing the outer side surface of the center electrode in the radial direction of the center electrode and a second end joined to the base member. It is preferable that a cross sectional area S3 of the discharge member, which is perpendicular to the lengthwise direction of the discharge member, is in the range of 0.1 to 0.8 $mm^2$; a distance F3 from the first end of the discharge member to the base member in the lengthwise direction of the discharge member is in the rang of 0.3 to 1.5 mm.

Furthermore, it is also preferable that in both the spark plugs S1 and S2, the threaded portion of the metal shell has a size less than or equal to M12.

It is further preferable that in both the spark plugs S1 and S2, the threaded portion of the metal shell has a size less than or equal to M10.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1:
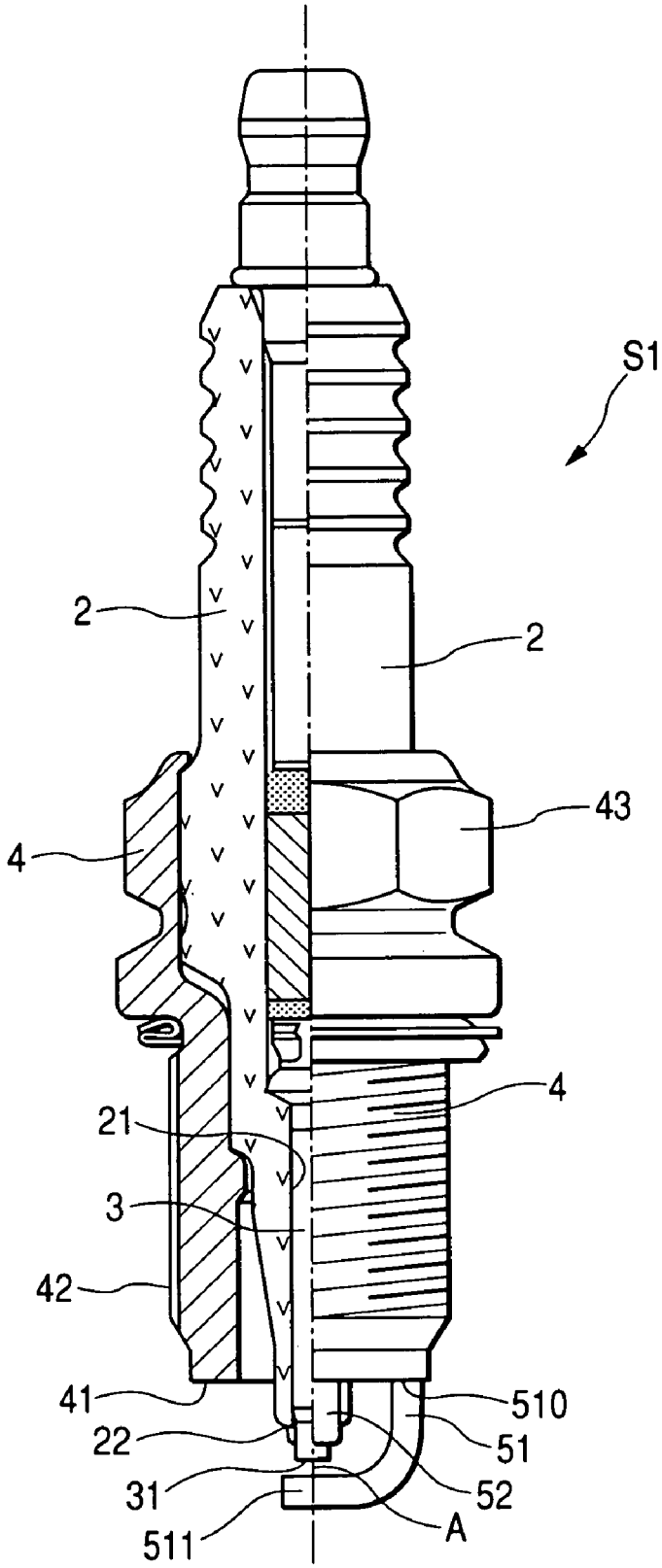
FIG. 1 is a partially cross-sectional side view showing the overall structure of a spark plug according to the first embodiment of the invention.

The preferred embodiments of the present invention will be described hereinafter with reference to FIGS. 1–35.

It should be noted that, for the sake of clarity and understanding, identical components having identical functions in different embodiments of the invention have been marked, where possible, with the same reference numerals in each of the figures.

[First Embodiment]

Figure 2:
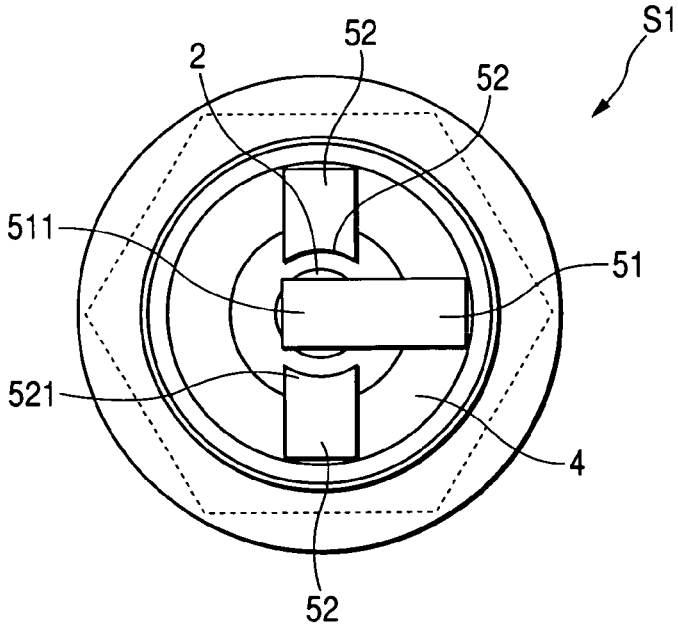
FIG. 2 is an end view of the spark plug of FIG. 1.
Figure 3:
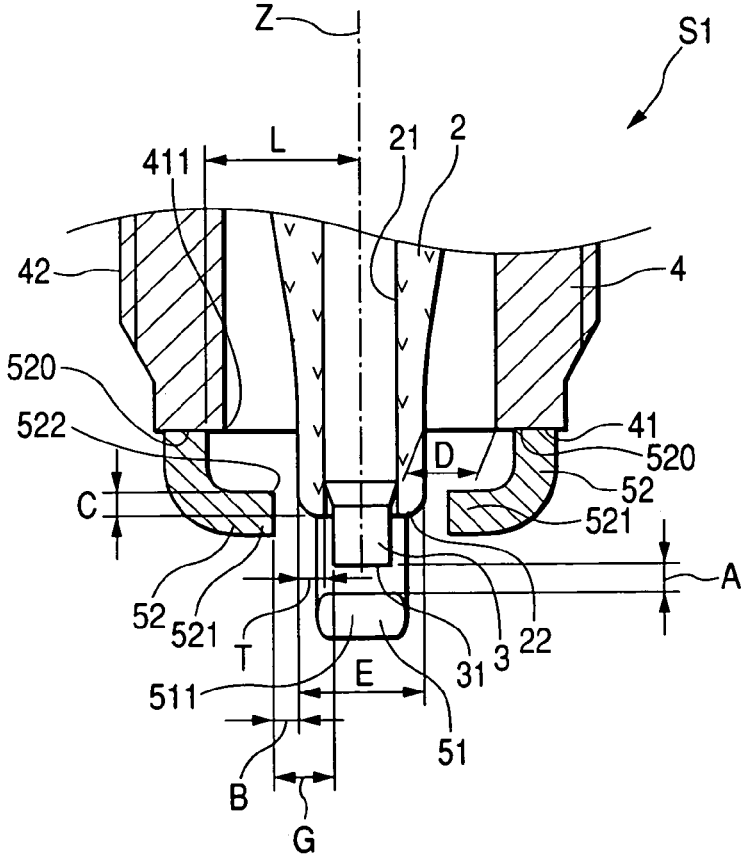
FIG. 3 is an enlarged partially cross-sectional side view showing an end portion of the spark plug of FIG. 1.

FIGS. 1–3 show the overall structure of a spark plug S1 according to the first embodiment of the invention. The spark plug S1 is designed for use in an internal combustion engine of an automotive vehicle.

The spark plug S1 includes an insulator 2, a cylindrical center electrode 3, a tubular metal shell 4, a first ground electrode 51, and a pair of second ground electrodes 52.

The tubular metal shell 4 has a male threaded portion 42 formed on an outer periphery thereof and a hexagonal head portion 43. The male threaded portion 42 has a size of M14 as specified in JIS. The metal shell 4 is made of a conductive metal material, for example low-carbon steel.

The installation of the spark plug S1 in an internal combustion engine is achieved by fitting it into a combustion chamber (not shown) of the engine. More specifically, in the installation, the hexagonal head portion 43 is torqued so as to establish an engagement between the male threaded portion 42 of the metal shell 4 and a female threaded bore provided in the cylinder head (not shown) of the combustion chamber.

The insulator 2 is fixed and partially contained in the metal shell 4 such that an end 22 of the insulator 2 protrudes from an end 41 of the metal shell 4. The insulator 2 has a through-bore 21 that extends in the lengthwise direction of the insulator 2. The insulator 2 is made of alumina ceramic ($Al_2O_3$).

The cylindrical center electrode 3 is secured in the through-bore 21 of the insulator 2, so that it is electrically isolated from the metal shell 4. The center electrode 3 is partially included in the metal shell 4 together with the insulator 2 such that an end 31 of the center electrode 3 protrudes from the end 22 of the insulator 2.

The center electrode 3 is made of a highly heat conductive metal material such as Cu as the core material and a highly heat-resistant, corrosion-resistant metal material such as a Ni (Nickel)-based alloy as the cladding material.

The first ground electrode 51 has a base end 510 that is joined, for example by resistance welding, to the end 41 of the metal shell 4. The first ground electrode 51 also has a tip portion 511 that faces the end 31 of the center electrode 3 in the axial direction of the center electrode 3 through a first spark gap.

The first ground electrode 4 is made, for example, of a Ni-based alloy; it is column-shaped, for example an approximately L-shaped prism in this embodiment.

The two second ground electrodes 52 are disposed, as shown in FIGS. 2–3, on the same diameter line of the metal shell 4, with the center electrode 3 interposed therebetween.

Each second ground electrode 52 has a base end 520 that is joined, for example by resistance welding, to the end 41 of the metal shell 4; it also has a tip portion 521 that has an end surface facing the outer side surface of the center electrode 3 through a second spark gap.

In this embodiment, as shown in FIG. 2, the end surface of the tip portion 521 of each of the second ground electrodes 52 is recessed in the radial direction of the center electrode 3.

Each second ground electrode 52 is made, for example, of a Ni-based alloy; it is column-shaped, for example an approximately L-shaped prism in this embodiment.

The spark plug S1 is configured to discharge, when the insulator 2 is not fouled with carbon, normal sparks across the first spark gap, thereby igniting the air/fuel mixture within the combustion chamber of the engine; it is also configured to discharge, when the insulator 2 is fouled with carbon, side sparks across the second spark gaps, thereby cleaning the insulator 2 through burning off the carbon deposit thereon.

Having described the overall structure of the spark plug S1, dimensional parameters A, T, B, C, D, and E, which are critical to the ignition capability and durability of the spark plug S1, will be defined and specified hereinafter with reference to FIGS. 3–5.

The parameter A is defined as the minimum distance between the end 31 of the center electrode 3 and the tip portion 511 of the first ground electrode 51 in the axial direction of the center electrode 3. The parameter A is to be simply referred to as a size A of the first spark gap hereinafter.

In this embodiment, the size A of the first spark gap is specified, through experimental investigation, to be in the range of 0.4 to 1.0 mm.

Figure 23:
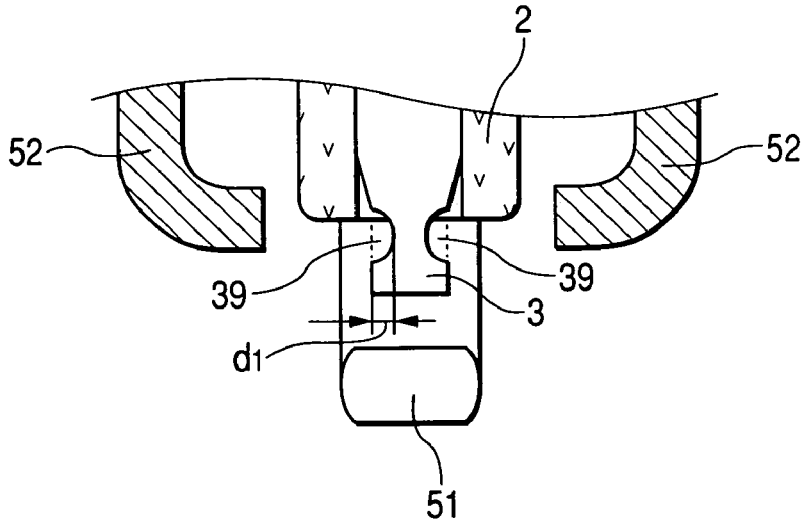
FIG. 23 is a view illustrating a maximum wear depth d1 on the outer side surface of a center electrode of a spark plug.
Figure 25:
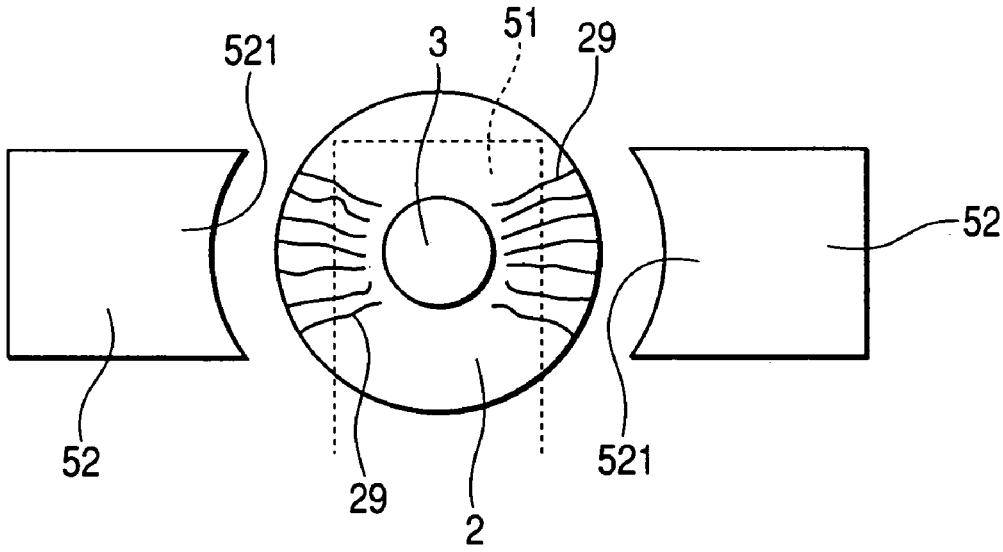
FIGS. 25 and 26 are views illustrating a maximum channel depth d2 on an insulator of a spark plug.
Figure 27:
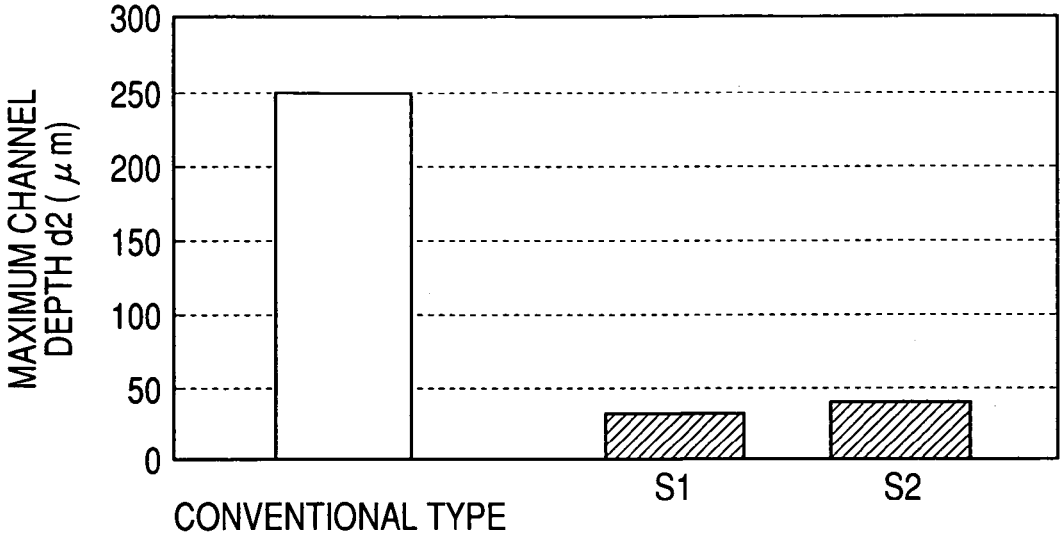
FIG. 27 is a graphical representation showing the maximum channel depths d2 in three different spark plugs.

Through specifying the upper limit of the size A of the first spark gap as above, when the insulator 2 is not fouled with carbon, normal sparks can be reliably discharged across the first spark gap, thereby preventing side sparks from occurring. Consequently, formation of channels on the insulator 2 (as illustrated in FIGS. 25 and 27) and wear of the center electrode 3 (as illustrated in FIG. 23) can be suppressed.

On the contrary, through specifying the lower limit of the size A of the first spark gap as above, the flame core is allowed to grow without interference and the Coefficient of Variation (COV) of Indicated Mean Effective Pressure (IMEP) for the engine can be made small. Consequently, the ignition capability of the spark plug S1 is secured.

The parameter T is defined as the wall thickness of the insulator 2 at the end 22 of the insulator 2. The parameter T is to be simply referred to as a wall thickness T of the insulator 2 hereinafter.

In this embodiment, the wall thickness T of the insulator 2 is specified, through experimental investigation, to be in the range of 0.3 to 0.8 mm.

Through specifying the upper limit of the wall thickness T of the insulator 2 as above, the thermal capacity of the insulator 2 is allowed to be small, so that the end 22 of the insulator 2 can be easily heated to a high temperature. Consequently, the carbon that has adhered to the end 22 can be easily burnt off, so that the insulator 2 is prevented from being fouled with carbon. It is especially advantageous that the insulator 2 can still be prevented from being fouled with carbon even when the size A of the first spark gap is made so small as to be not greater than 1.0 mm.

On the contrary, through specifying the lower limit of the wall thickness T of the insulator 2 as above, the strength of the insulator 2 at the end 22 is secured.

The parameter B is defined as the minimum distance between the insulator 2 and the tip portion 521 of each of the second ground electrodes 52. The parameter B is to be simply referred to as a distance B hereinafter.

In this embodiment, the distance B is specified, through experimental investigation, to be in the range of 0.2 to 0.9 mm.

Through specifying the upper limit of the distance B as above, it is possible to prevent occurrence of "inside sparks" in the spark plug S1 when the insulator 2 is fouled with carbon, thereby preventing misfire of the engine.

The inside sparks here denote sparks which creep from the center electrode 3 along the outer surface of the insulator 2 to the inside of an air pocket formed between the outer surface of the insulator 2 and the inner surface of the metal shell 4, and jump across the air pocket to the inner surface of the metal shell 4. The inside sparks will result in misfire of the engine, because the space in the inside of the air pocket is so small that the initial flame therein cannot successfully propagate.

Further, it is preferable that the distance B is less than (A−0.05), so that side sparks can be more reliably discharged across the second spark gaps when the insulator 2 is fouled with carbon, thus cleaning the insulator 2 by burning off the carbon deposit on the insulator 2.

On the contrary, through specifying the lower limit of the distance B as above, it is possible to prevent formation of "fuel bridge" in the spark plug S1 at low temperatures, so that a shunt of the spark plug S1 is prevented, and the engine can be successfully started up.

The fuel bridge here denotes a phenomenon in which liquid fuel fills the space between the insulator 2 and the tip portion 521 of each of the second ground electrodes 52, thus forming a bridge of fuel across the space.

The parameter C is defined as a distance between an edge 522 of the tip portion 521 of each of the second ground electrodes 52 and the inner edge of the end 22 of the insulator 2 in the axial direction of the center electrode 3; the edge 522 faces the end 41 of the metal shell 4. The parameter C is to be simply referred to as a distance C hereinafter.

In this embodiment, the distance C is specified, through experimental investigation, to be in the range of −1.0 to 0.5 mm.

Figure 4:
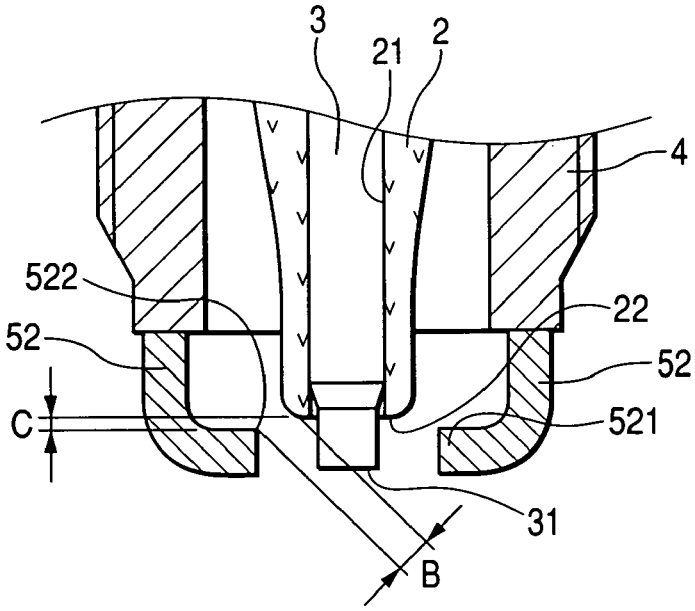
FIG. 4 is an enlarged partially cross-sectional side view illustrating the distance C in the spark plug of FIG. 1 when it takes a positive value.
Figure 5:
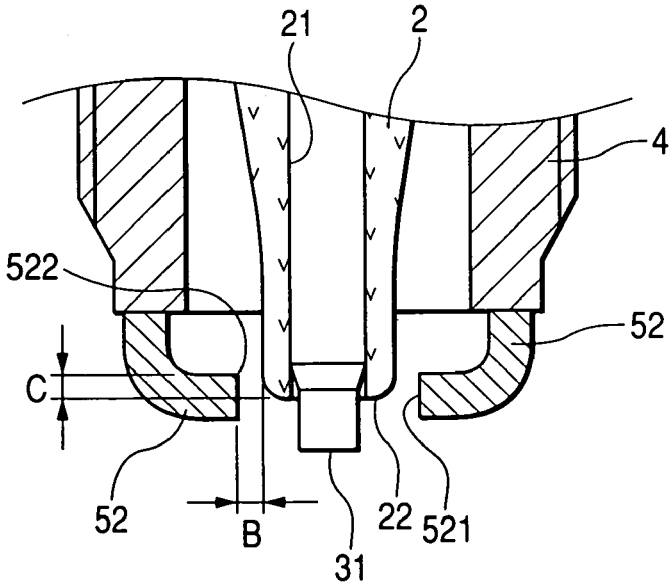
FIG. 5 is an enlarged partially cross-sectional side view illustrating the distance C in the spark plug of FIG. 1 when it takes negative value.

The distance C takes a positive value when the edge 522 is, as shown in FIG. 4, closer to the end 31 of the center electrode 3 than the inner edge of the end 22 of the insulator 2 in the axial direction of the center electrode 3. On the contrary, the distance C takes a negative value when the edge 522 is, as shown in FIG. 5, more away from the end 31 of the center electrode 3 than the inner edge of the end 22 of the insulator 2 in the axial direction of the center electrode 3.

Through specifying the upper limit of the distance C as above, it is possible to prevent inside sparks from occurring in the spark plug S1.

On the contrary, through specifying the lower limit of the distance C as above, the initial flame in the second spark gaps is allowed to successfully propagate, thus securing the ignition capability of the spark plug S1 when the insulator 2 is fouled with carbon.

The parameter D is defined as a distance between the inner edge 411 of the end 41 of the metal shell 4 and the outer surface of the insulator 2 in the radial direction of the center electrode 3. The parameter D is to be simply referred to as a distance D hereinafter.

In this embodiment, the distance D is, preferably, specified to be in the range of 0.6 to 1.6 mm.

Through specifying the above range, the insulation resistance between the center electrode 3 and the metal shell 4 is secured, the insulator 2 is prevented from being fouled with carbon, and the ignition capability of the spark plug S1 is secured.

This is because if the distance D is above the upper limit, it is easy for carbon to flow into the inside of the air pocket between the outer surface of the insulator 2 and the inner surface of the metal shell 4. Consequently, carbon will easily deposit on the inside section of the outer surface of the insulator 2, thus causing the insulator 2 to be fouled with carbon and the insulation resistance between the center electrode 3 and the metal shell 4 to be decreased.

On the contrary, if the distance D is below the lower limit, side sparks will be discharged from the insulator 2 to the inner edge 411 of the end 41 of the metal shell 4 (not to the tip portion 521 of each of the second ground electrodes 52) when the insulator 2 is fouled with carbon, thus decreasing the ignition capability of the spark plug S1.

The parameter E is defined as the outer diameter of the insulator 2 at the end 22 of the insulator 2. The parameter E is to be simply referred to as an end diameter E of the insulator 2 thereinafter.

In this embodiment, the end diameter E of the insulator 2 is, preferably, specified to be in the range of 2.1 to 3.9 mm.

Through specifying the upper limit of the end diameter E of the insulator 2 as above, the thermal capacity of that end portion of the insulator 2, which includes the end 22, is allowed to be sufficiently small, so that it can be easily heated to a high temperature, thus cleaning the insulator 2 by burning off the carbon deposit thereon.

On the contrary, through specifying the lower limit of the end diameter E of the insulator 2 as above, the center electrode 3 is prevented from being made too thin, so that the heat range of the spark plug S1 is secured and pre-ignition of the air-fuel mixture is prevented.

To sum up, the spark plug S1 according to the present embodiment has an improved structure, where the size A of the first spark gap, the wall thickness T of the insulator 2, the distance B, and the distance C are specified to be in the following ranges:

$0.4\ \text{mm} \leqq A \leqq 1.0\ \text{mm}$;

$0.3\ \text{mm} \leqq T \leqq 0.8\ \text{mm}$;

$0.2\ \text{mm} \leqq B \leqq 0.9\ \text{mm}$ (preferably, $0.2\ \text{mm} \leqq B \leqq (A-0.05\ \text{mm})$); and $-1.0\ \text{mm} \leqq C \leqq 0.5\ \text{mm}$.

Through specifying the above ranges, a high ignition capability and a long service life of the spark plug S1 are ensured.

It is preferable that in the spark plug S1, the distance D is specified to be in the range of 0.6 to 1.6 mm.

It is also preferable that in the spark plug S1, the end diameter E of the insulator 2 is specified to be in the range of 2.1 to 3.9 mm.

The above ranges of the parameters A, T, B, C, D, and E have been determined through the experiments to be described below.

Experiment 1

This experiment was conducted to determine the effect of the size A of the first spark gap on the performance of the spark plug S1.

Sample spark plugs having the size A of the first spark gap in the range of 0.4 to 1.6 mm were fabricated for the experiment, in each of which: the wall thickness T of the insulator 2 was 1.0 mm; the distance 3 was 0.5 mm; the distance C was −0.2 mm; and the minimum distance L between the inner edge of the base end 520 of each of the second ground electrodes 52 and the axis Z of the center electrode 3 was 4.5 mm.

It is necessary to note that the above value of 1.0 mm for the wall thickness T of the insulator 2 is out of the range of 0.3 to 0.8 mm specified for the spark plug S1; however, the experimental results still hold for the spark plug S1 since the wall thickness T of the insulator 2 has almost no influence on the relationship between the size A of the first spark gap and the occurrence rate of side sparks in the spark plug S1.

First, the sample spark plugs were tested using two different engines to determine the effect of the size A of the first spark gap on the occurrence rate of side sparks in the spark plug S1.

The first engine was a general engine of 600 cc, four-cylinder, and normal aspiration; the second one was a high flow speed engine of 2500 cc, six-cylinder, and with a supercharger. A test condition of full throttle, and 5600 rpm was used for both engines, under which it is easy for side sparks to occur.

Figure 6:
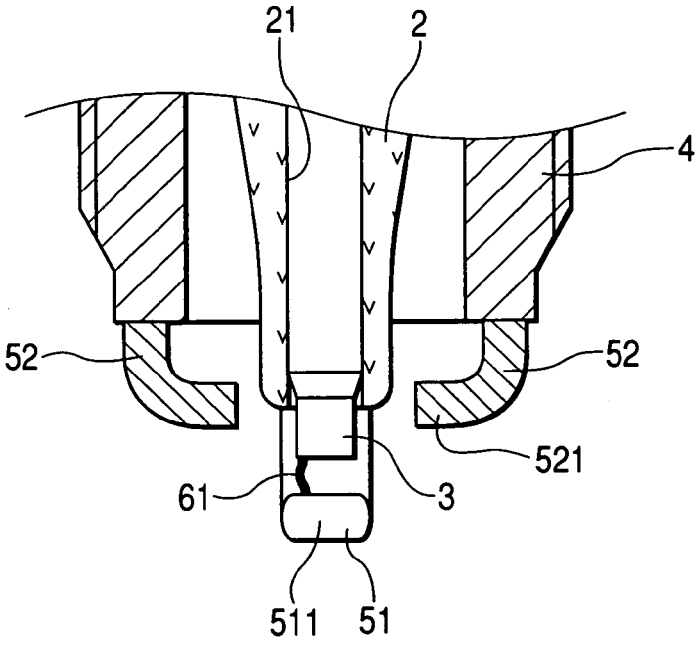
FIG. 6 is an enlarged partially cross-sectional side view illustrating normal sparks being discharged in the spark plug of FIG. 1.
Figure 7:
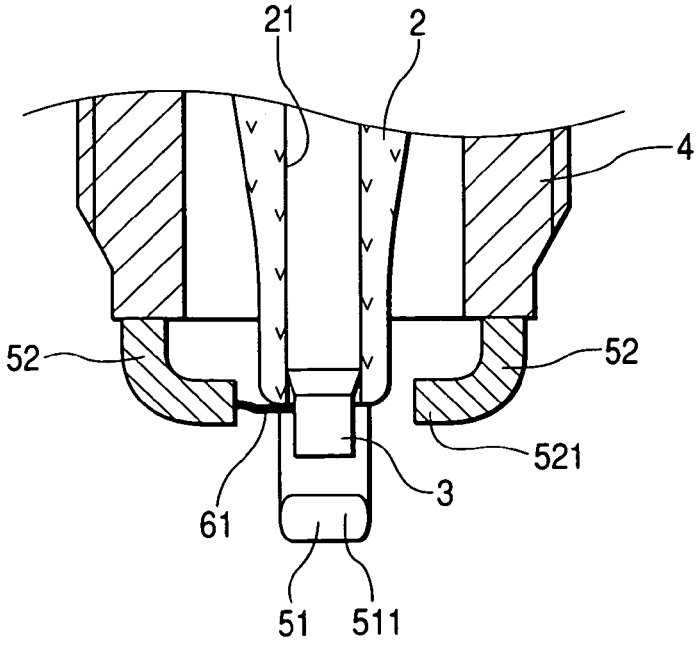
FIG. 7 is an enlarged partially cross-sectional side view illustrating side sparks being discharged in the spark plug of FIG. 1.

Each of the sample spark plugs was tested for 200 continuous cycles of engine operation. During the test, normal sparks 61 as illustrated in FIG. 6 were discharged for some cycles; side sparks 62 as illustrated in FIG. 7 were discharged for other cycles.

An occurrence of side sparks during the test was determined based on the waveform of the discharge voltage of the sample spark plug; then the ratio of the number of occurrence of side sparks to the total number of discharge (i.e., 200) was counted as the occurrence rate of side sparks for the sample spark plug.

Figure 8:
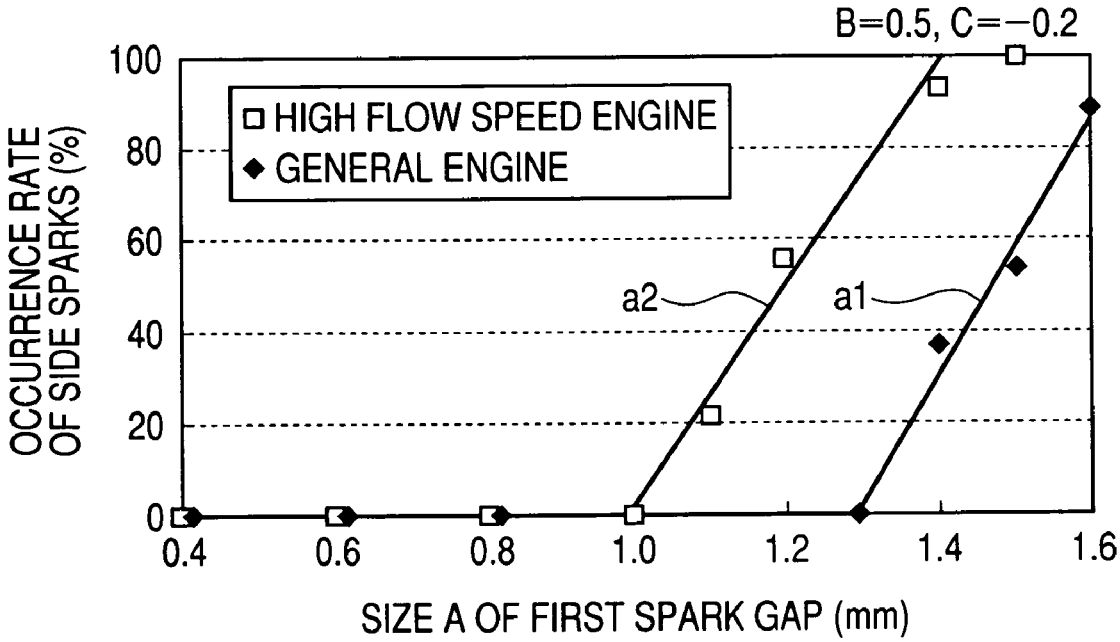
FIG. 8 is a graphical representation showing the relationship between the size A of the first spark gap and the occurrence rate of side sparks in the spark plug of FIG. 1.

FIG. 8 shows the test results, where the curve a1 indicates the results with the general engine, while the curve a2 indicates those with the high flow speed engine.

As seen from FIG. 8, with the general engine, when the size A of the first spark gap was not greater than 1.3 mm, side sparks were prevented from occurring in normal conditions of the sample spark plugs, so that formation of channels on the insulator 2 and wear of the center electrode 3 in the sample spark plugs were suppressed.

In other words, when used in a general engine, it is possible to ensure a long service life of the spark plug S1 if the size A of the first spark gap is in the conventional range of 1.1 to 1.3 mm.

As also seen from FIG. 8, with the high flow speed engine, side sparks occurred in normal conditions of the sample spark plugs when the size A of the first spark gap was not less than 1.1 mm.

In other words, when used in a high flow speed engine, side sparks may occur in the spark plug S1 in normal condition thereof, if the size A of the first spark gap is in the conventional range of 1.1 to 1.3 mm.

This is because in this case normal sparks become difficult to be discharged across the first spark gap due to the high flow speed and high pressure in the proximity of the first spark gap, so that side sparks may be discharged, instead of normal sparks, from the outer surface of the insulator 2 to the each of the second ground electrodes 52. As a result, channels may be formed on the end 22 of the insulator 2 and wear on the outer side surface of the center electrode 3 may increase, thus decreasing the reliability and service life of the spark plug S1.

On the contrary, it can be seen from FIG. 8 that, when used in a high flow speed engine, it is possible to prevent side sparks from occurring in the spark plug S1 in normal condition thereof through specifying the size A of the first spark gap to be not greater than 1.0 mm.

This is because the required voltage of the spark plug S1 for discharging normal sparks decreases with the size A of the first spark gap, so that it becomes easy for normal sparks to be discharged across the first spark gap. Consequently, side sparks are prevented from occurring, so that formation of channels on the insulator 2 and wear of the center electrode 3 in the spark plug S1 are suppressed.

Secondly, the sample spark plugs were tested using the high flow speed engine to determine the effect of the size A of the first spark gap on the ignition capability of the spark plug S1.

The ignition capability of the spark plug S1 was evaluated in terms of COV of IMEP for 200 continuous cycles of the engine operation. The COV of IMEP here can be represented by (standard deviation of IMEP/arithmetic mean of IMEP)× 100%. A test condition of idling, and 700 rpm was used.

Figure 9:
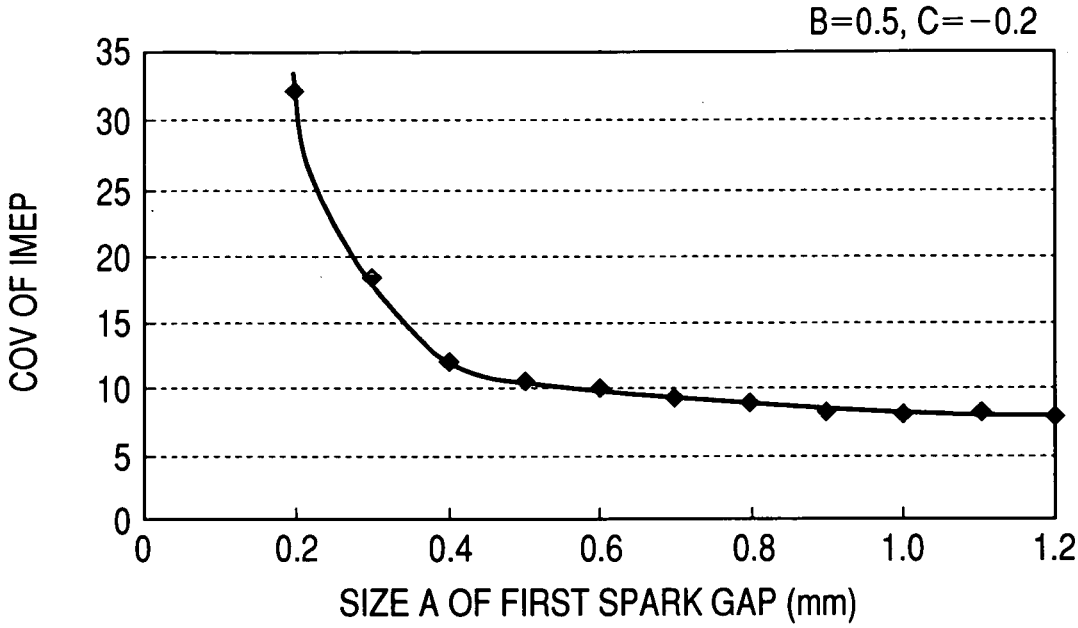
FIG. 9 is a graphical representation showing the relationship between the size A of the first spark gap in the spark plug of FIG. 1 and the COV of IMEP of an engine tested.

FIG. 9 shows the test results, where the horizontal axis indicates the size A of the first spark gap, while the vertical one indicates the resultant COV of IMEP.

As seen from FIG. 9, the COV of IMEP increased, in other words, the ignition capability of the sample spark plugs decreased with decrease in the size A of the first spark gap. When the size A of the first spark gap was less than 0.4 mm, the ignition capability of the sample spark plugs dropped considerably. This is because when the size A of the first spark gap was too small, the flame core could not grow successfully.

In other words, specifying the size A of the first spark gap to be not greater than 0.4 mm, the ignition capability of the spark plug S1 can be secured.

Accordingly, specifying the size A of the first spark gap in the spark plug S1 to be in the range of 0.4 to 1.0 mm, formation of channels on the insulator 2 and wear on the outer side surface of the center electrode 3 can be suppressed and the ignition capability of the spark plug S1 can be secured.

Experiment 2

This experiment was conducted to determine the effect of the wall thickness T of the insulator 2 on the performance of the spark plug S1.

Three sample spark plugs having different sizes A of the first spark gap and wall thicknesses T of the insulator 2 were fabricated for the experiment. The first one was a conventional spark plug, in which the size A of the first spark gap was 1.1 mm, and the wall thickness T of the insulator 2 was 1.0 mm. The second one was obtained by reducing the size A of the first spark gap, in which A was 0.7 mm, and T was 1.0 mm. The third one was obtained by reducing both the size A of the first spark gap and the wall thickness T of the insulator 2, in which A was 0.7 mm, and T was 0.6 mm. Additionally, in each of the sample spark plugs, the distance B was 0.5 mm and the distance C was −0.2 mm.

The sample spark plugs were tested using an automobile that was driven by a direct injection engine of 2000 cc, and 4 cycles. It is necessary to note that, when a spark plug used in such a direct injection engine, it is very easy for the insulator 2 of the spark plug to be fouled with carbon.

Specifically, each of the sample spark plugs was installed in the engine; then the engine was run at an ambient temperature of −20° C. according to a running pattern for 10 cycles. The running pattern was designed to simulate pre-delivery fouling which occurs when new cars are delivered from factories to dealers. At the end of each cycle, the insulation resistance between the center electrode 3 and metal shell 4 of the sample spark plug was measured according to the measurement method specified in JIS B 8031.

Figure 10:
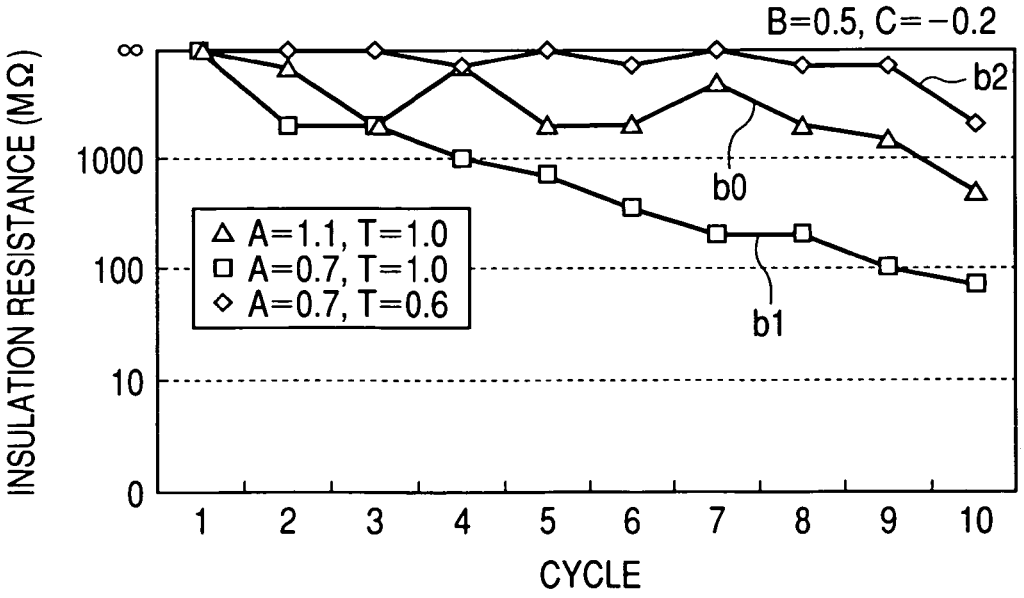
FIG. 10 is a graphical representation showing the change of insulation resistance of the spark plug of FIG. 1 with running of an engine tested.

FIG. 10 shows the test results, where the curve b0 indicates the results for the first sample spark plug, the curve b1 indicates those for the second one, and the curve b2 indicates those for the third one.

As seen from FIG. 10, with running of the engine, the insulation resistance of the second sample spark plug decreased more rapidly than that of the first sample spark plug.

This is because in the second sample spark plug, the occurrence rate of side sparks became low, even when the insulator 2 had already been fouled with carbon, due to the reduced size A of the first spark gap. Consequently, the self-cleaning effect of the second sample spark plug by side sparks (i.e., the effect of burning off the carbon deposit on the insulator 2 through side sparks) was decreased, and the insulation resistance of the same was accordingly decreased.

On the contrary, as seen from FIG. 10, with running of the engine, the insulation resistance of the third sample spark plug decreased more slowly than that of the first sample spark plug.

This is because in the third sample spark plug, the temperature at the end 22 of the insulator 2 became high due to the reduced wall thickness T of the insulator 2. Consequently, the self-cleaning effect of the third sample spark plug by high temperature was enhanced, and the insulation resistance of the same was accordingly decreased.

To make a thorough investigation of the effect of the wall thickness T of the insulator 2 on the performance of the spark plug S1, sample spark plugs having different wall thicknesses T of the insulator 2 were fabricated and tested in the same way as in the above test. In each of the sample spark plugs, the size A of the first park gap was 0.7 mm, the distance B was 0.5 mm, and the distance C was −0.2 mm. For each of the sample spark plugs, the insulation resistance between the center electrode 3 and the metal shell 4 was measured only once at the end of the tenth cycle of the engine running.

Figure 11:
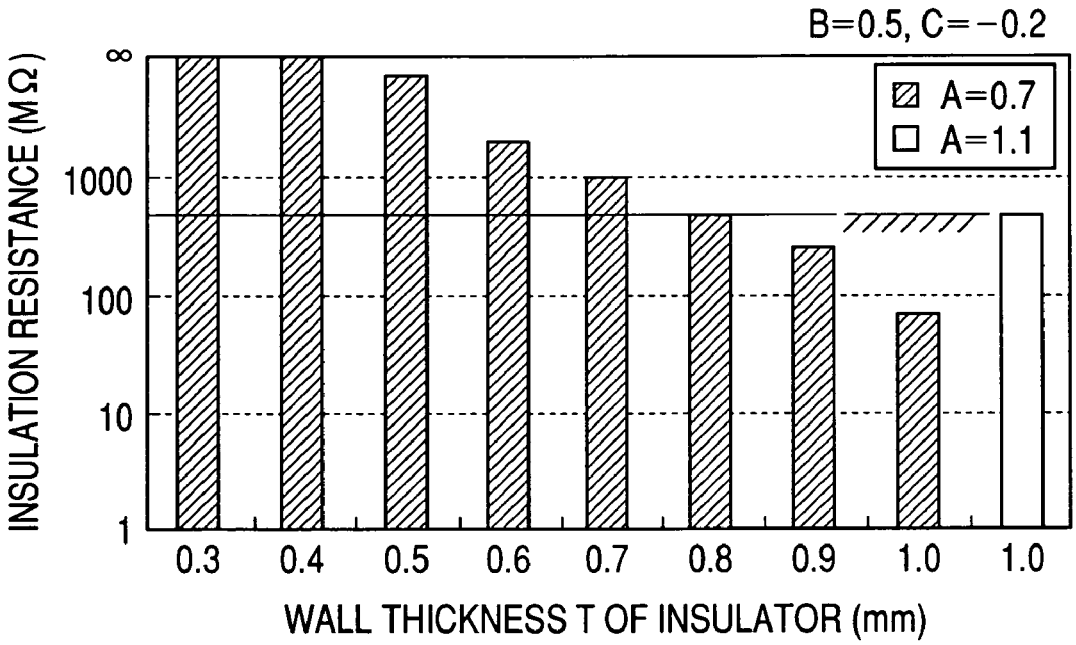
FIG. 11 is a graphical representation showing the relationship between the wall thickness T of the insulator and the insulation resistance of the spark plug of FIG. 1.

FIG. 11 shows the test results, where the white bar indicates the insulation resistance of the above-described conventional spark plug having the A of 1.1 mm and T of 1.0 mm, while the hatched bars indicate the insulation resistances of the sample spark plugs having the same A of 0.7 mm and different Ts.

As seen from FIG. 11, the insulation resistance between the center electrode 3 and the metal shell 4 increased with decrease in the wall thickness T of the insulator 2. When the wall thickness T of the insulator 2 was decreased to 0.8 mm, the insulation resistance of the sample spark plug having the reduced A of 0.7 mm became equal to that of the conventional spark plug.

In other words, specifying the wall thickness T of the insulator 2 to be not greater than 0.8 mm, the insulator 2 can be prevented from being fouled with carbon and the insulation resistance of the spark plug S1 can be secured.

Further, it is necessary for the wall thickness T of the insulator 2 to be not less than 0.3 mm, so that the strength of the insulator 2 at the end 22 thereof can be secured.

Accordingly, specifying the wall thickness T of the insulator 2 to be in the range of 0.3 to 0.8 mm, the insulator 2 can be prevented from being fouled with carbon and the strength of the insulator 2 can be secured.

Experiment 3

This experiment was conducted to determine the effect of the distance B on the performance of the spark plug S1.

Sample spark plugs having different distances B were fabricated, in each of which the size A of the first spark gap was 0.7 mm, and the distance C was −0.2 mm.

First, to determine the effect of the distance B on the ignition capability of the spark plug S1 at low temperatures, the sample spark plugs were tested using the above-described general engine.

Figure 12:
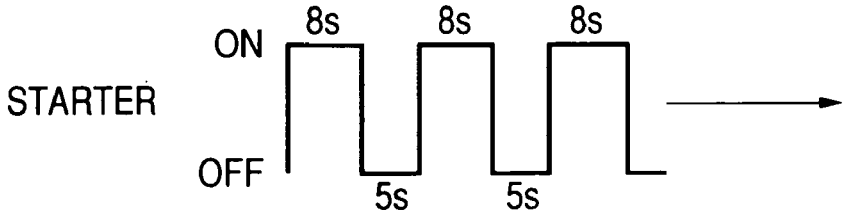
FIG. 12 is a view illustrating the manner of an ON-OFF operation of an engine starter tested with the spark plug of FIG. 1.

Specifically, during the test, an ON/OFF operation of the starter of the engine was repeated in the manner as shown in FIG. 12, at an ambient temperature of −25° C., until the engine was successfully started up. Then, the number of repeating the ON/OFF operation was recorded for each of the sample spark plugs.

The smaller number of repeating the ON/OFF operation indicates that the sample spark plug had a better ignition capability at the low temperature of −25° C. When the number of repeating the ON/OFF operation was not greater than thrice, the sample spark plug was considered to have a sufficient ignition capability.

Figure 13:
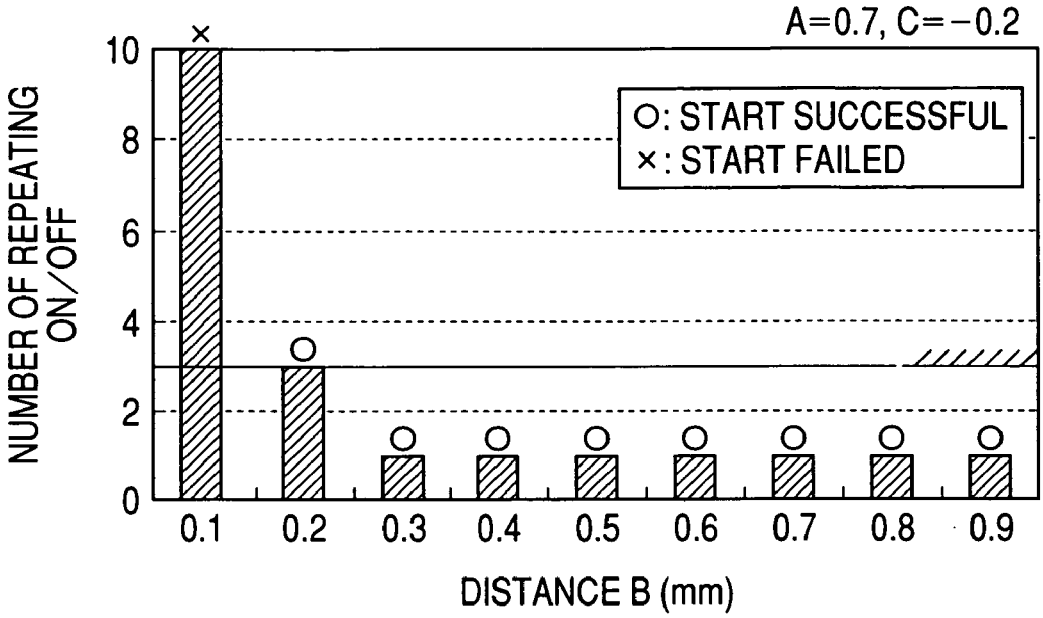
FIG. 13 is a graphical representation showing the relationship between the distance B in the spark plug of FIG. 1 and the startability of an engine tested.

FIG. 13 shows the test results, where the horizontal axis indicates the distance B, while the vertical one indicates the number of repeating the ON/OFF operation. Additionally, in the figure, the plot of "○" indicates the engine start was successful, while the plot of "X" indicates the engine start was failed.

As seen from FIG. 13, when the distance B was equal to 0.1 mm, the engine start was failed though the ON/OFF operation was repeated 10 times. This is because, according to a check after the test, a fuel bridge was formed between the outer surface of the insulator 2 and the tip portion 521 of each of second ground electrodes 52 in the sample spark plug.

On the contrary, when the distance B was not less than 0.2 mm, the engine start was successful by repeating the ON/OFF operation at most thrice.

In other words, specifying the distance B to be not less than 0.2 mm, it is possible to prevent formation of fuel-bridge in the spark plug S1 at low temperatures, so that the engine can be successfully started up.

Secondly, to determine the effect of the distance B on the occurrence rate of inside sparks in the spark plug S1, the sample spark plugs were tested using the above-described high flow speed engine. The test condition was full throttle, and 5600 rpm. In addition, to force the sample spark plugs to discharge inside sparks, the first ground electrodes 51 were removed from those sample spark plugs.

Figure 14:
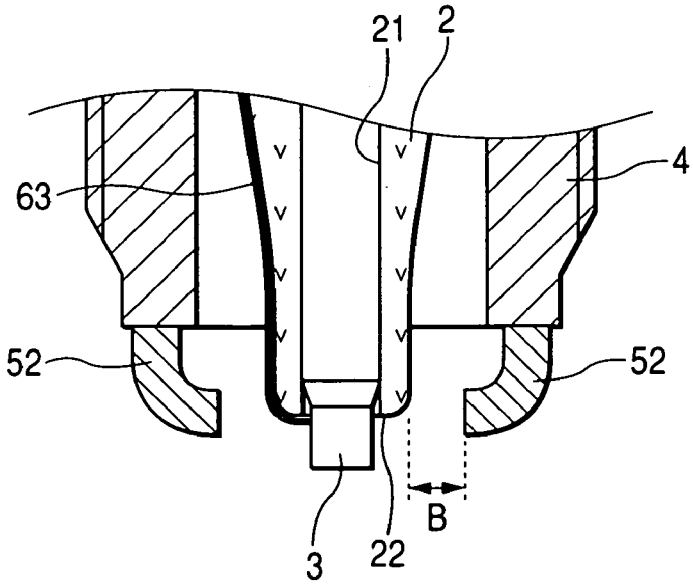
FIG. 14 is an enlarged partially cross-sectional side view illustrating "inside sparks" being discharged in the spark plug of FIG. 1.

As described previously, inside sparks may occur in the spark plug S1 when the insulator 2 is fouled with carbon. As illustrated in FIG. 14, inside sparks creep from the outer side surface of the center electrode 3 along the path 63 to the inside of the air pocket, and jump across the air pocket to the inner surface of the metal shell 4.

The inside sparks will result in misfire of the engine, because the space in the inside of the air pocket is so small that the initial flame therein cannot successfully propagate.

Figure 15:
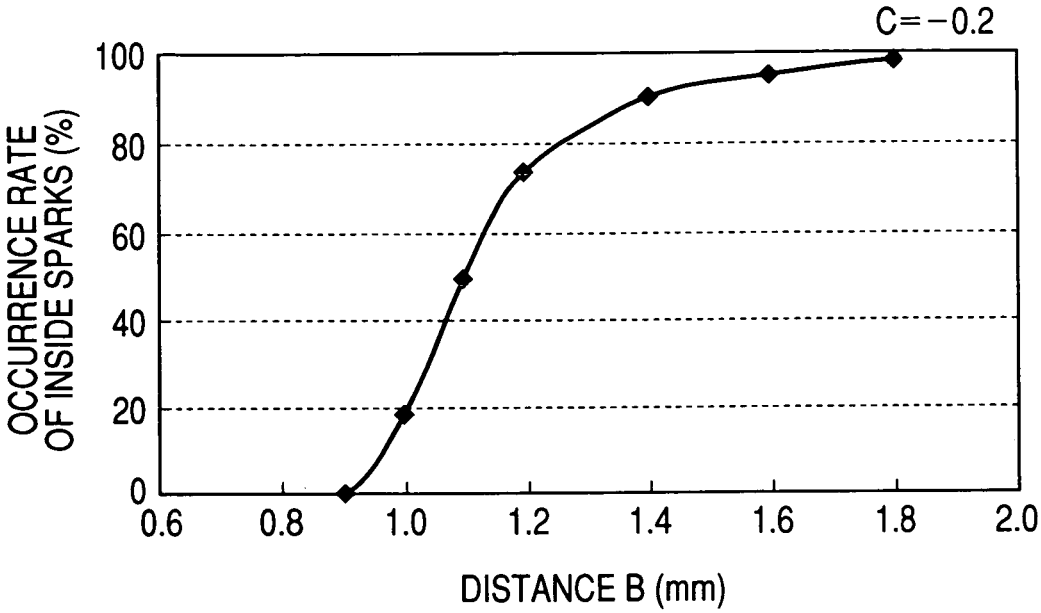
FIG. 15 is a graphical representation showing the relationship between the distance B and occurrence rate of "inside sparks" in the spark plug of FIG. 1.

FIG. 15 shows the test results, where the horizontal axis indicates the distance B, while the vertical one indicates the resultant occurrence rate of inside sparks.

As seen from FIG. 15, when the distance B was not greater than 0.9 mm, inside sparks were completely suppressed.

In other words, specifying the distance B to be not greater than 0.9 mm, inside sparks can be prevented from occurring in the spark plug S1, thereby preventing misfire of the engine.

Accordingly, specifying the distance B to be in the range of 0.2 to 0.9 mm, the ignition capability of the spark plug S1 can be secured at low temperatures and misfire of the engine due to inside sparks can be prevented.

Experiment 4

This experiment was conducted to determine the effect of the distance C on the ignition capability of the spark plug S1 by side sparks.

In the experiment, the above-described high flow speed engine was used, and the test condition was idling, and 700 rpm.

The ignition capability of the spark plug S1 by side sparks was also evaluated in terms of COV of IMEP for 200 continuous cycles of the engine operation as in the experiment 2. In addition, to force sample spark plugs to discharge side sparks, the first ground electrodes 51 were removed from the sample spark plugs.

Figure 16:
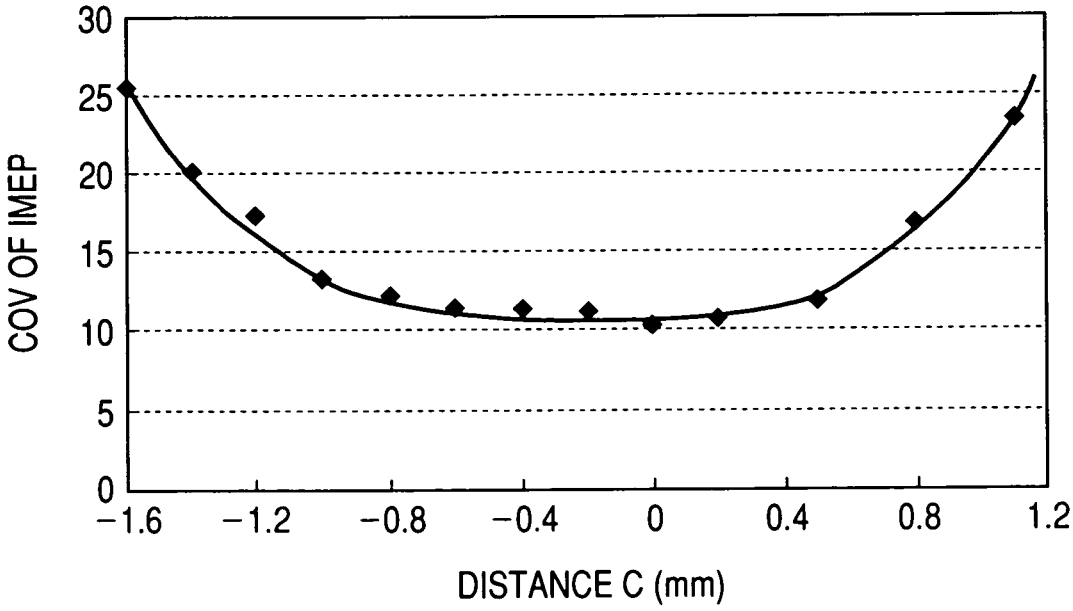
FIG. 16 is a graphical representation showing the relationship between the distance C in the spark plug of FIG. 1 and the COV of IMEP of an engine tested.

FIG. 16 shows the test results, where the horizontal axis indicates the distance C, while the vertical one indicates the resultant COV of IMEP.

As seen from FIG. 16, when the distance C decreased to below −1.0 mm, the COV of IMEP increased rapidly. This is because as the distance C decreased, the space available for the initial flame to propagate accordingly decreased.

In other words, to secure the ignition capability of the spark plug S1 by side sparks, it is necessary for the distance C to be not less than −1.0 mm.

On the other hand, when the distance C increased to above 0.5 mm, the COV of IMEP also increased rapidly. This is because as the distance C increased, the distance B accordingly increased, thus causing inside sparks to occur.

In other words, to secure the ignition capability of the spark plug S1 by side sparks, it is also necessary for the distance C to be not greater than 0.5 mm.

Accordingly, specifying the distance C to be in the range of −1.0 to 0.5 mm, the ignition capability of the spark plug S1 by side sparks can be secured.

Experiment 5

This experiment was conducted to determine the relationship between the size A of the first spark gap and the distance B.

Sample spark plugs having different sizes A of the first spark gap and distances B were fabricated for the experiment, in each of which the distance C was −0.2 mm, and the wall thickness T of the insulator 2 was 0.6 mm.

The sample spark plugs were tested in the same way as in the experiment 2, and the insulation resistance between the center electrode 3 and the metal shell 4 in each of those sample spark plugs was measured at the end of the tenth cycle of the engine running.

Figure 17:
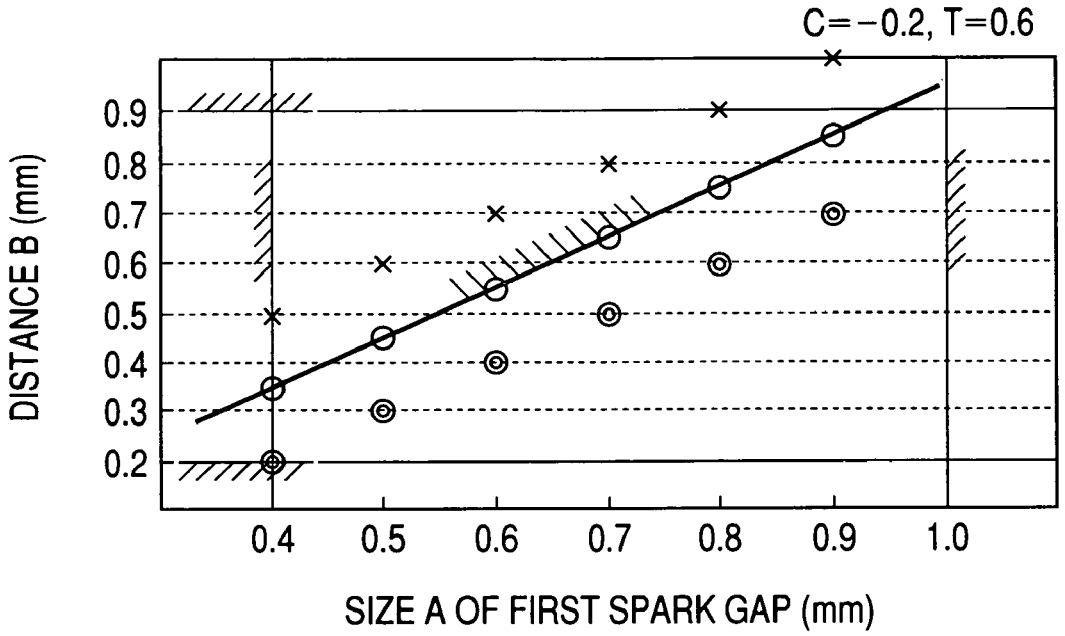
FIG. 17 is a graphical representation showing the relationship between the size A of the first spark gap and distance B and the insulation resistance of the spark plug of FIG. 1.

FIG. 17 shows the test results, where the plots of "○" indicate the sample spark plugs having the insulation resistance in the same level as that of the above-described conventional spark plug, the plots of "o" indicate those having the insulation resistance superior to that of the conventional spark plug, and the plots of "X" indicate those having the insulation resistance inferior to that of the conventional spark plug.

As seen from FIG. 17, when the distance B was greater than (A−0.05 mm), the insulation resistance of the sample spark plug was inferior to that of the conventional spark plug. This is because side sparks became difficult to be discharged even when the insulator 2 had been fouled with carbon, so that the insulator 2 could not be cleaned by burning off the carbon deposit thereon through side sparks.

Accordingly, specifying the distance B to be less than (A−0.05 mm), side sparks can be reliably discharged in the spark plug S1 when the insulator 2 is fouled with carbon, thereby cleaning the insulator 2.

Experiment 6

This experiment was conducted to determine the effect of the distance D on the performance of the spark plug S1.

Sample spark plugs having different distances D were fabricated for the experiment, in each of which the size A of the first spark gap was 0.7 mm, the distance B was 0.5 mm, the distance C was −0.2 mm, and the wall thickness T of the insulator 2 was 0.6 mm.

The sample spark plugs were tested in the same way as in the experiment 2, and the insulation resistance between the center electrode 3 and the metal shell 4 in each of those sample spark plugs was measured at the end of the tenth cycle of the engine running.

Figure 18:
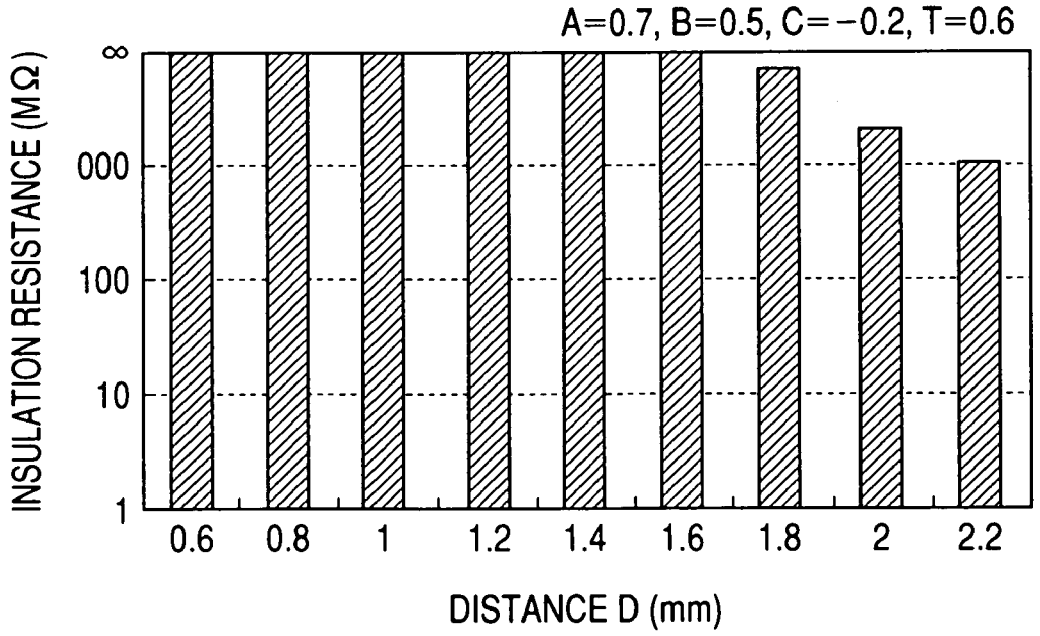
FIG. 18 is a graphical representation showing the relationship between the distance D and the insulation resistance of the spark plug of FIG. 1.

FIG. 18 shows the test results, where the horizontal axis indicates the distance D, while the vertical one indicates the resultant insulation resistance.

As seen from FIG. 18, the insulation resistance increased with decrease in the distance D. This is because, according to a check after the test, with the smaller distance D, the less carbon had deposited on the inside section of the outer surface of the insulator 2, in other words, it became more difficult for carbon to flow into the air pocket between the outer surface of the insulator 2 and the inner surface of the metal shell 4.

It can be seen from FIG. 18 that specifying the distance D to be not greater than 1.6 mm, the insulation resistance of the spark plug S1 can be secured.

Moreover, though not shown in drawings, when the distance D decreased to below 0.6 mm, the ignition capabilities of the sample spark plugs decreased rapidly. This is because when the distance D was too small, side sparks were discharged from the insulator 2 to the inner edge 411 of the end 41 of the metal shell 4 (not to the tip portion 521 of each of the second ground electrodes 52) when the insulator 2 is fouled with carbon.

Accordingly, specifying the distance D to be in the range of 0.6 to 1.6 mm, the insulation resistance and ignition capability of the spark plug S1 can be secured.

Experiment 7

This experiment was conducted to determine the effect of the end diameter E of the insulator 2 on the performance of the spark plug S1.

Sample spark plugs having different end diameters E of the insulator 2 were fabricated for the experiment, in each of which the size A of the first spark gap was 0.7 mm, the wall thickness T of the insulator 2 was 0.6 mm, the distance B was 0.5 mm, and the distance C was −0.2 mm.

The sample spark plugs were tested in the same way as in the experiment 2, and the insulation resistance between the center electrode 3 and the metal shell 4 in each of those sample spark plugs was measured at the end of the tenth cycle of the engine running.

Figure 19:
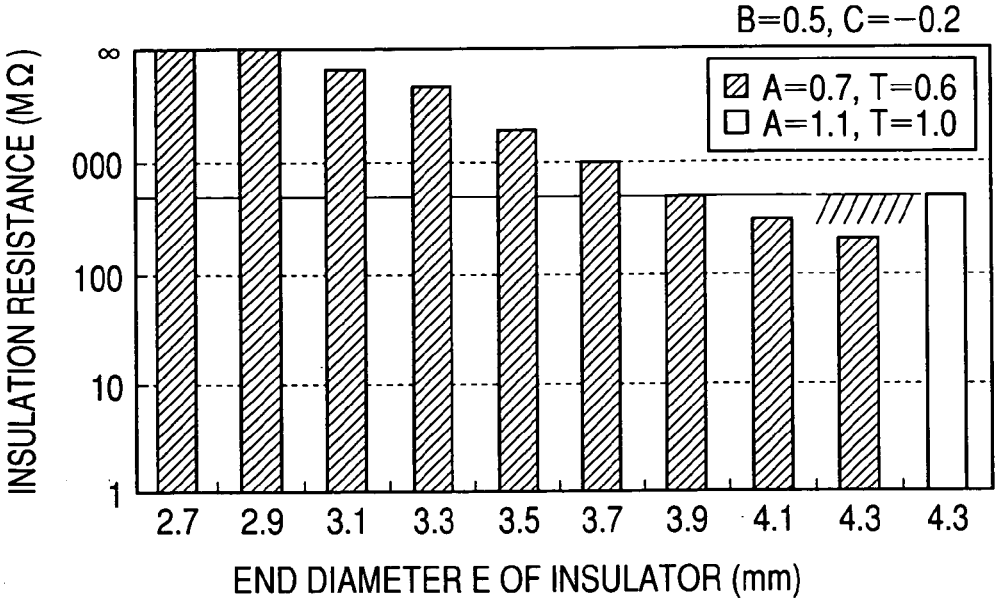
FIG. 19 is a graphical representation showing the relationship between the end diameter E of the insulator and the insulation resistance of the spark plug of FIG. 1.

FIG. 19 shows the test results, where the hatched bars indicate the insulation resistances of the sample spark plugs having different end diameters E of the insulator 2, while the white bar indicates the insulation resistance of the above-described conventional spark plug in which the size A of the first spark gap was 1.1 mm, the wall thickness T of the insulator 2 was 1.0 mm, and the end diameter E of the insulator 2 was 4.3 mm.

As seen from FIG. 19, the insulation resistance increased with decrease in the end diameter E of the insulator 2. This is because with the smaller end diameter E of the insulator 2, the end portion of the insulator 2 including the end 22 had the smaller thermal capacity, so that it could be more easily heated to a high temperature, thus cleaning the insulator 2 by burning off the carbon deposit thereon.

It can be seen from FIG. 19 that specifying the end diameter E of the insulator 2 to be not greater than 3.9 mm, the insulation resistance of the spark plug S1 can be secured.

Moreover, though not shown in drawings, when the end diameter E of the insulator 2 decreased to below 2.1 mm, the outer diameter of the center electrode 3 decreased accordingly to below 1.5 mm. Consequently, heat could not be effectively transferred from the insulator 2 through the center electrode 3 to the outside of the combustion chamber, thus inducing a pre-ignition of the air-fuel mixture.

In other words, to secure the heat range of the spark plug S1 and prevent pre-ignition of the air-fuel mixture, it is necessary for the end diameter E of the insulator 2 to be not less than 2.1 mm.

Accordingly, specifying the end diameter E of the insulator 2 to be in the range of 2.1 to 3.9 mm, the insulation resistance and heat range of the spark plug S1 can be secured.

[Second Embodiment]

This embodiment illustrates a spark plug S2, which has a structure almost identical to that of the spark plug S1 according to the previous embodiment.

The only difference between the spark plugs S1 and S2 is that in the spark plug 2, the effective range of a parameter L is specified, instead of that of the size A of the first spark gap as specified in the spark plug S1.

Figure 20:
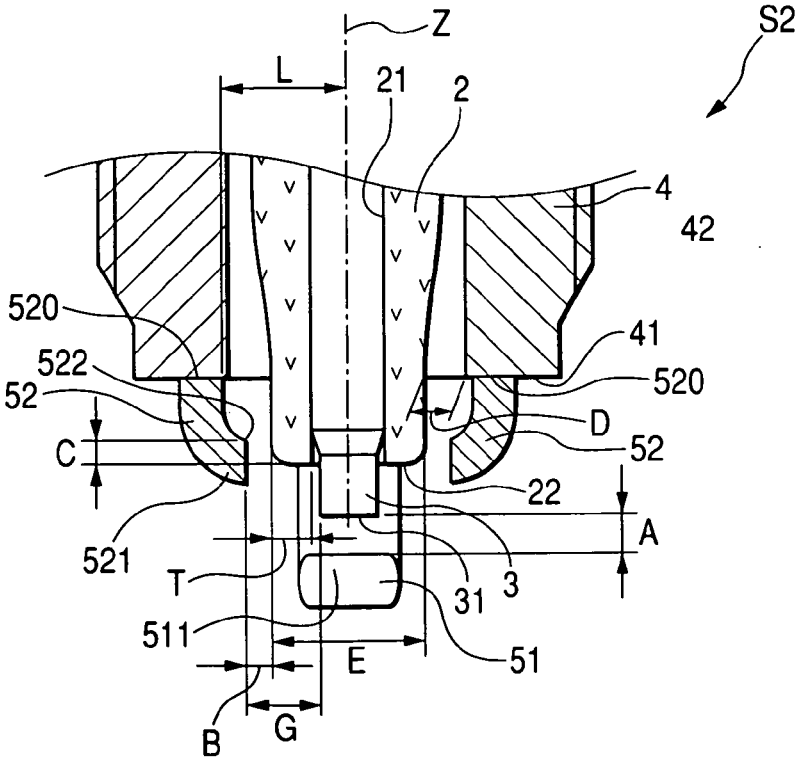
FIG. 20 is an enlarged partially cross-sectional side view showing an end portion of a spark plug according to the second embodiment of the invention.

The parameter L is defined, with reference to FIG. 20, as a distance between the inner edge of the base end 520 of each of the second ground electrodes 52 and the axis Z of the center electrode 3 in the radial direction of the center electrode 3. The parameter L is to be simply referred to as a distance L hereinafter.

In this embodiment, the distance L is specified, through experimental investigation, to be less than or equal to 3.5 mm.

Consequently, in the spark plug S2 according to the present embodiment, the distance L, the wall thickness T of the insulator 2, the distance B, and the distance C are specified to be in the following ranges:

$L \leqq 3.5$ mm;

$0.3 \text{ mm} \leqq T \leqq 0.8$ mm;

$0.2 \text{ mm} \leqq B \leqq 0.9$ mm; and $-1.0 \text{ mm} \leqq C \leqq 0.5$ mm.

Figure 26:
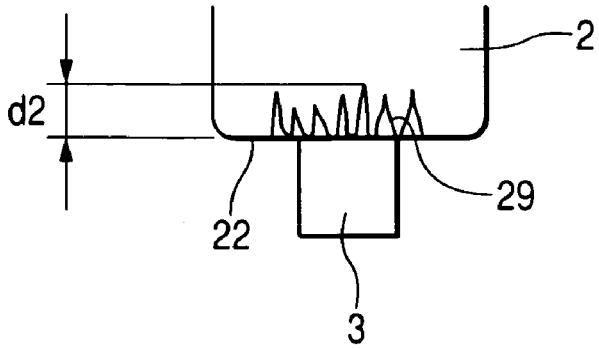

Through specifying the range of the distance L as above, the required voltage of the spark plug S2 for discharging normal sparks are made small. Thus, when the insulator 2 is not fouled with carbon, normal sparks can be reliably discharged across the first spark gap, thereby preventing side sparks from occurring. Consequently, formation of channels on the insulator 2 (as illustrated in FIGS. 25 and 26) and wear of the center electrode 3 (as illustrated in FIG. 23) can be suppressed.

Through specifying the ranges of the parameters T, B, and C as above, the same effects are obtained as in the previous embodiment.

Accordingly, a high ignition capability and a long service life of the spark plug S2 is ensured.

It is preferable that in the spark plug S2, the distance L is specified to be not less than (D+E/2), so that the joining strength between the metal shell 4 and each of the second ground electrodes 52 can be secured.

It is also preferable that in the spark plug S2, the size A of the first spark gap is specified to be in the range of 0.4 to 1.1 mm.

As a result, side sparks can be more reliably prevented from occurring when the insulator 2 is not fouled with carbon, so that formation of channels on the insulator 2 and wear of the center electrode 3 can be more reliably suppressed. At the same time, the COV of IMEP for the engine can be suppressed, and the ignition capability of the spark plug S2 can be more reliably secured.

Further, it is also preferable that in the spark plug S2, the distance D is specified to be in the range of 0.6 to 1.6 mm, so that the same effect can be obtained as in the previous embodiment.

Furthermore, it is also preferable that in the spark plug S2, the end diameter E of the insulator 2 is specified to be in the range of 2.1 to 3.9 mm, so that the same effect can be obtained as in the previous embodiment.

The above range of the distance L has been determined through an experiment to be described below.

Experiment 8

This experiment was conducted to determine the effect of the distance L on the performance of the spark plug S2.

Sample spark plugs having different distances L were fabricated for the experiment, in each of which the size A of the first spark gap was 1.1 mm, the distance B was 0.5 mm, the distance C was −0.2 mm, the distance D was 0.6 mm, the end diameter E of the insulator 2 was 4.3 mm, and the wall thickness T of the insulator 2 was 1.0 mm.

First, the sample spark plugs were tested to determine the effect of the distance L on the required voltage for discharging normal sparks.

In the test, each sample spark plug was installed in a closed air chamber in the same manner as in the case of being installed in a combustion chamber of an engine. The pressure in the air chamber was kept at 0.6 Mpa; the temperature and pressure outside the air chamber were room temperature and atmospheric pressure, respectively. Then, the maximum and minimum required voltages for 200 continuous cycles of discharge were determined based on the waveform of the discharge voltage.

Figure 21:
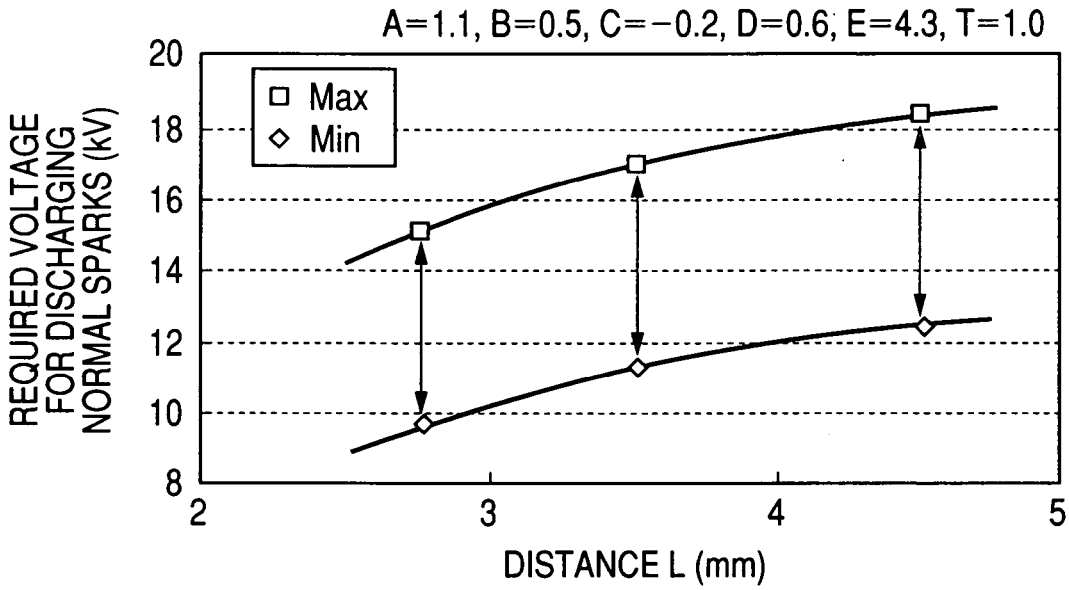
FIG. 21 is a graphical representation showing the relationship between the distance L and the required voltage of the spark plug of FIG. 20 for discharging normal sparks.

FIG. 21 shows the test results, where the plots of "□" indicate the maximum required voltages, while the plots of "◇" indicate the minimum required voltages.

As seen from FIG. 21, both the maximum and minimum required voltages for discharging normal sparks decreased with the distance L.

In other words, it was made clear that the required voltage of the spark plug S2 for discharging normal sparks could be lowered by reducing the distance L.

The above test results can be explained as follows: the second ground electrodes 52 provided an effect of suppressing dissipation of the electric field in the first spark gap (in other words, strengthening the electric field in the first spark gap), thereby lowering the required voltage for discharging normal sparks; such an effect was enhanced by reducing the distance L.

Secondly, to determine the effect of the distance L on the occurrence rate of side sparks, the sample spark plugs were tested in the same way as in the experiment 1.

Figure 22:
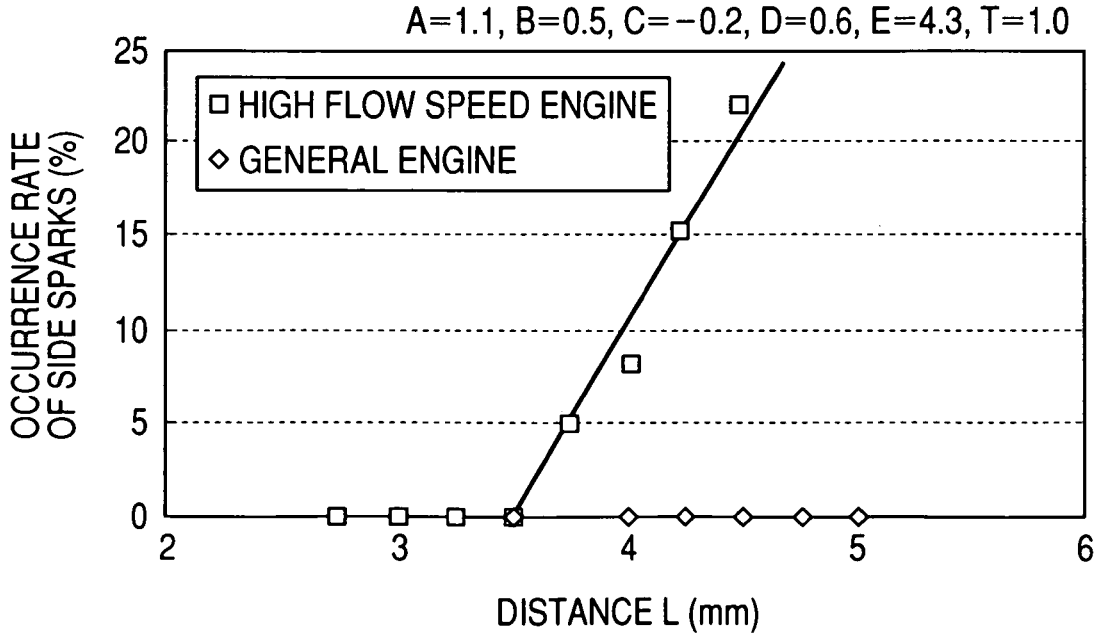
FIG. 22 is a graphical representation showing the relationship between the distance L and occurrence rate of side sparks in the spark plug of FIG. 20.

FIG. 22 shows the test results, where the plots of "□" indicate the results with the general engine, while the plots of "◇" indicate those with the high flow speed engine.

As seen from FIG. 22, with the general engine, when the distance L was not greater than 5 mm, side sparks were prevented from occurring in normal conditions of the sample spark plugs, so that formation of channels on the insulator 2 and wear of the center electrode 3 in the sample spark plugs were suppressed.

In other words, when used in a general engine, it is possible to ensure a long service life of the spark plug S2 if the distance L has a conventional value of 4.5 mm.

Further, as seen from FIG. 8, with the high flow speed engine, side sparks occurred in normal condition of the sample spark plug when the distance L had the conventional value of 4.5 mm. However, when the distance L was not greater than 3.5 mm, side sparks were prevented from occurring in normal conditions of the sample spark plugs.

In other words, when used in a high flow speed engine, it is possible to ensure a long service life of the spark plug S2 if the distance L is not greater than 3.5 mm.

This is because the required voltage of the spark plug S2 for discharging normal sparks decreases with the distance L as explained above, so that it becomes easy for normal sparks to be discharged across the first spark gap. Consequently, side sparks can be prevented from occurring in normal condition of the spark plug S2, so that formation of channels on the insulator 2 and wear of the center electrode 3 in the spark plug S2 can be suppressed.

In addition, the size A of the first spark gap used in this experiment was 1.1 mm. However, it is easy to understand that with a size A of the first spark gap smaller than 1.1 mm, such as those specified in the first embodiment, side sparks can be more reliably prevented from occuring in normal condition of the spark plug S2.

Accordingly, specifying the distance L to be not greater than 3.5 mm, formation of channels on the insulator 2 and wear on the outer side surface of the center electrode 3 can be suppressed and the ignition capability of the spark plug S2 can be secured.

Experiment 9

This experiment was conducted to evaluate wear on the outer side surface of the center electrode 3 and formation of channels on the insulator 2 in the spark plugs S1 and S2 according to the present invention and the above-described conventional spark plug.

The values of parameters A, B, C, D, E, T, and L in each of the three spark plugs are given in TABLE 1.

First, the spark plugs were tested to evaluate wear on the

TABLE 1

| | Conventional | S1 | S2 |
|---|---|---|---|
| A | 1.1 | 0.7 | 1.1 |
| B | 0.5 | 0.5 | 0.5 |
| C | −0.2 | −0.2 | −0.2 |
| D | 2.2 | 1.3 | 1.3 |
| E | 4.3 | 3.3 | 3.3 |
| T | 1.0 | 0.6 | 0.6 |
| L | 4.5 | 4.5 | 3.1 |

outer side surface of the center electrode 3. The above-described high flow speed engine was used in the test; the test condition was full throttle, and 5600 rpm, under which it is easy for side sparks to occur.

The wear on the outer side surface of the center electrode 3 was evaluated in terms of "maximum wear depth d1". The maximum wear depth d1 here denotes, with reference to FIG. 23, the maximum depth of that recessed portion 39 of the center electrode 3 which is formed due wear. During the test, the maximum wear depth d1 was measured at 30-hr intervals for 180 hr.

Figure 24:
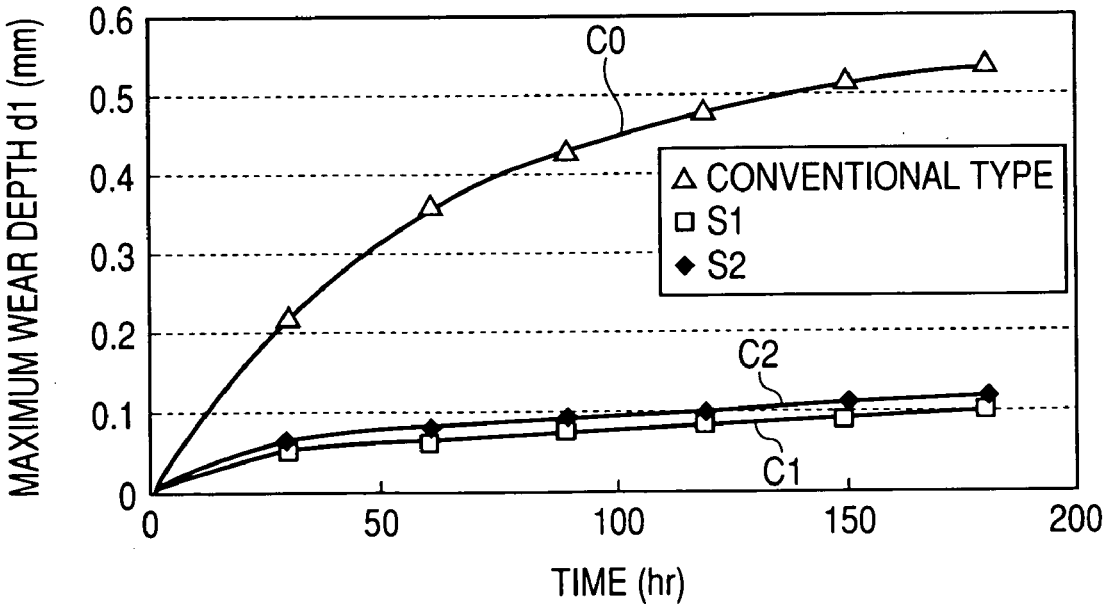
FIG. 24 is a graphical representation showing the changes of maximum wear depth d1 in three different spark plugs.

FIG. 24 shows the test results, where the curve C0 indicates results for the conventional spark plug, the curve C1 indicates those for the spark plug S1, and the curve C2 indicates those for the spark plug S2.

As seen from FIG. 24, in both the spark plugs S1 and S2, the maximum wear depth d1 increased much more slowly than in the conventional spark plug.

In other words, compared to the conventional spark plug, both the spark plugs S1 and S2 according to the present invention have considerably higher resistance to wear on the outer side surface of the center electrode 3.

Secondly, the spark plugs were tested to evaluate formation of channels on the insulator 2. The above high flow speed engine was also used in the test; the test condition was 80% throttle, and 3600 rpm, under which it is easy for channels to be formed on the insulator 2.

The formation of channels on the insulator 2 was evaluated in terms of "maximum channel depth d2". The maximum channel depth d2 here denotes, with reference to FIGS. 25 and 26, the maximum depth of the channels, which are formed on the outer surface of the insulator 2 due to side sparks, from the end 22 of the insulator 2 in the lengthwise direction of the insulator 2. The maximum channel depth d2 was measured at the end of a 400 hr continuous engine running.

FIG. 27 shows the test results. As seen from the figure, in both the spark plugs S1 and S2, the maximum channel depth d2 was considerably smaller than in the conventional spark plug.

In other words, both the spark plugs S1 and S2 according to the present invention can suppress formation of channels on the insulator 2 more reliably than the conventional spark plug.

Accordingly, from the results of this experiment, it was made clear that both the spark plugs S1 and S2 according to the present invention have a long service life.

[Third Embodiment]

This embodiment illustrates a spark plug S3, which has a structure almost identical to those of the spark plugs S1 and S2 according to the previous embodiments.

The only difference between the spark plug S3 and the spark plugs S1 and S2 is that in the spark plug S3, the center electrode 3 and the first ground electrode 51 each include a discharge member that is made of a noble metal or its alloy.

Figure 28:
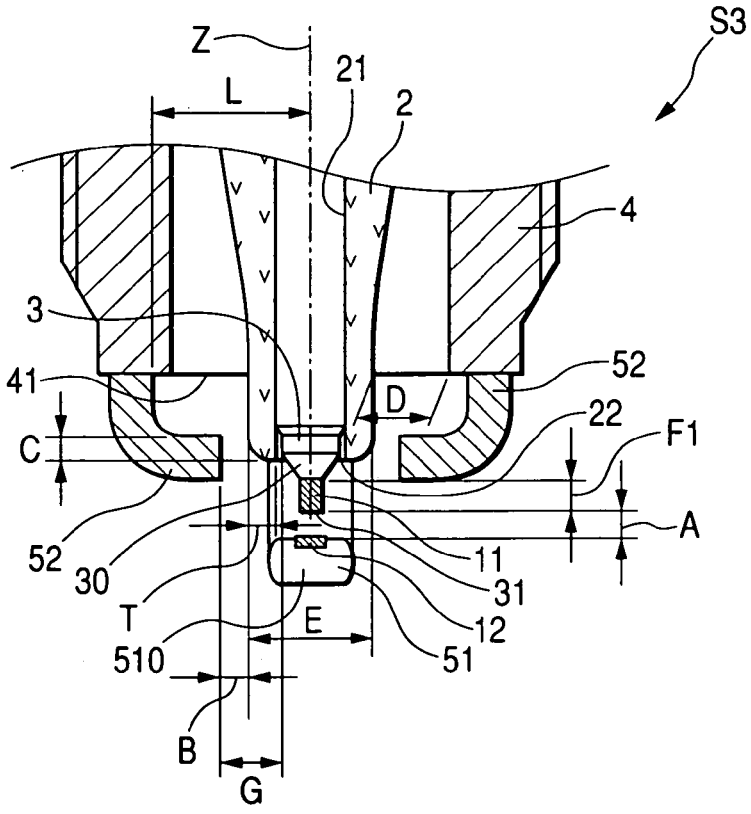
FIG. 28 is an enlarged partially cross-sectional side view showing an end portion of a spark plug according to the third embodiment of the invention.

Specifically, as shown in FIG. 28, the center electrode 3 consists of a base member 30 and a discharge member 11 The discharge member 11 has a first end representing the end 31 of the center electrode 3 and a second end that is joined, for example by laser welding, to the base member 30.

The discharge member 11 has a length F1, which is a distance from the first end of the discharge member 11 (i.e., the end 31 of the center electrode 3) to the base member 30 in the lengthwise direction of the discharge member 11.

In this embodiment, the length F1 of the discharge member 11 is specified to be in the range of 0.3 to 1.5 mm.

The discharge member 11 also has a cross sectional area S1 perpendicular to the lengthwise direction of the discharge member 11.

In this embodiment, the cross sectional area S1 of the discharge member 11 is specified to be in the range of 0.1 to 0.8 $mm^2$.

Through specifying the ranges of F1 and S1 as above, the ignition capability of the spark plug S3 is enhanced.

On the other hand, the first ground electrode 51 consists of a base member 510 and a discharge member 12. The discharge member 12 is partially embedded in the base member 510 such that an exposed face of the discharge member 12 faces the center electrode 3 in the axial direction of the center electrode 3.

In this embodiment, both the discharge members 11 and 12 are preferably made of a Pt-based alloy that includes Pt in an amount of not less than 50 weight percent and at least one additive selected from Ir, Rh, Ni, W, Pd, Ru, Os, Y, and $Y_2O_3$.

Otherwise, both the discharge members 11 and 12 are preferably made of an Ir-based alloy that includes Ir in an amount of not less than 50 weight percent and at least one additive selected from Pt, Rh, Ni, W, Pd, Ru, Os, Y, and $Y_2O_3$.

Specifying the material of the discharge members 11 and 12 as above, it is possible to suppress wear of those discharge members, thus ensuring a long service life of the spark plug S3.

[Fourth Embodiment]

This embodiment illustrates a spark plug S4, which has a structure almost identical to that of the spark plug S3 according to the previous embodiment.

The only difference between the spark plugs S3 and S4 is that in the spark plug S4, the discharge member 12 of the first ground electrode 51 protrudes from a side surface of the base member 510.

Figure 29:
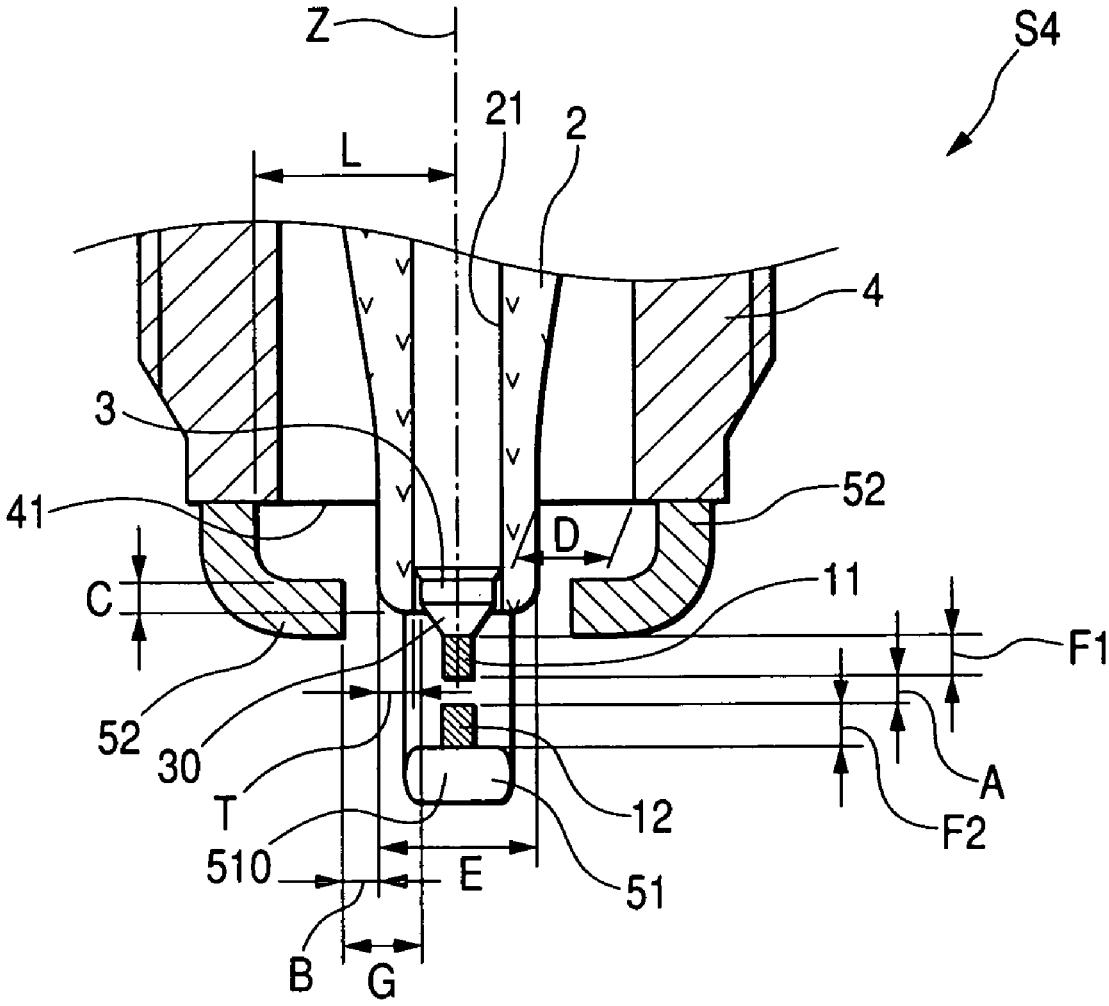
FIG. 29 is an enlarged partially cross-sectional side view showing an end portion of a spark plug according to the fourth embodiment of the invention.

Specifically, as shown in FIG. 29, the discharge member 12 has a first end facing the center electrode 3 in the axial direction of the center electrode 3 and a second end that is joined, for example by laser welding, to the base member 510.

The discharge member 12 has a length F2, which is a distance from the first end of the discharge member 12 to the side surface of the base member 510 in the lengthwise direction of the discharge member 12.

In this embodiment, the length F2 of the discharge member 12 is specified to be in the range of 0.3 to 1.5 mm.

The discharge member 12 also has a cross sectional area S2 perpendicular to the lengthwise direction of the discharge member 12.

In this embodiment, the cross sectional area S2 of the discharge member 12 is specified to be in the range of 0.1 to 0.8 $mm^2$.

Through specifying the ranges of F2 and S2 as above, the ignition capability of the spark plug S4 is enhanced.

[Fifth Embodiment]

This embodiment illustrates a spark plug S5, which has a structure almost identical to that of the spark plug S3 according to the third embodiment.

The only difference between the spark plugs S3 and S5 is that in the spark plug S5, each of the second ground electrodes 52 also includes a discharge member that is made of a noble metal or its alloy.

Figure 30:
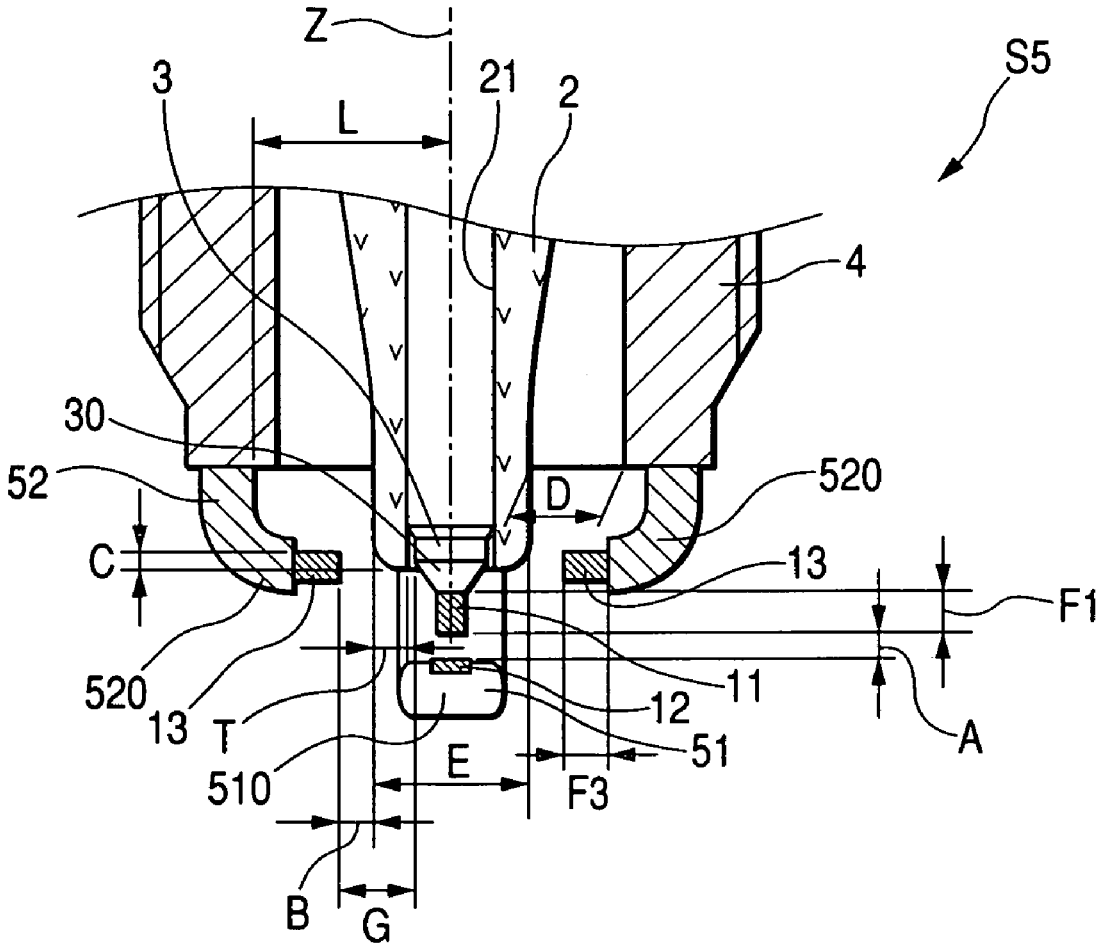
FIG. 30 is an enlarged partially cross-sectional side view showing an end portion of a spark plug according to the fifth embodiment of the invention.

Specifically, as shown in FIG. 30, each second ground electrode 52 consists of a base member 520 and a discharge member 13.

The discharge member 13 has a first end facing the outer side surface of the center electrode 3 in the radial direction of the center electrode 3 and a second end that is joined, for example by laser welding, to the base member 520.

The discharge member 13 has a length F3, which is a distance from the first end of the discharge member 13 to the base member 520 in the lengthwise direction of the discharge member 13.

In this embodiment, the length F3 of the discharge member 13 is specified to be in the range of 0.3 to 1.5 mm.

The discharge member 13 also has a cross sectional area S3 perpendicular to the lengthwise direction of the discharge member 13.

In this embodiment, the cross sectional area S3 of the discharge member 13 is specified to be in the range of 0.1 to 0.8 $mm^2$.

Through specifying the ranges of F3 and S3 as above, the ignition capability of the spark plug S3 is enhanced.

[Sixth Embodiment]

This embodiment illustrates a spark plug S6, which has a structure almost identical to those of the spark plugs S1–S5 according to the previous embodiments.

The only difference between the spark plugs S1–S5 and the spark plug S6 is that the threaded portion 42 of the metal shell 4 has a size of M14 in the spark plugs S1–S5; however, it has a size less than M14 in the spark plug S6.

Figure 31:
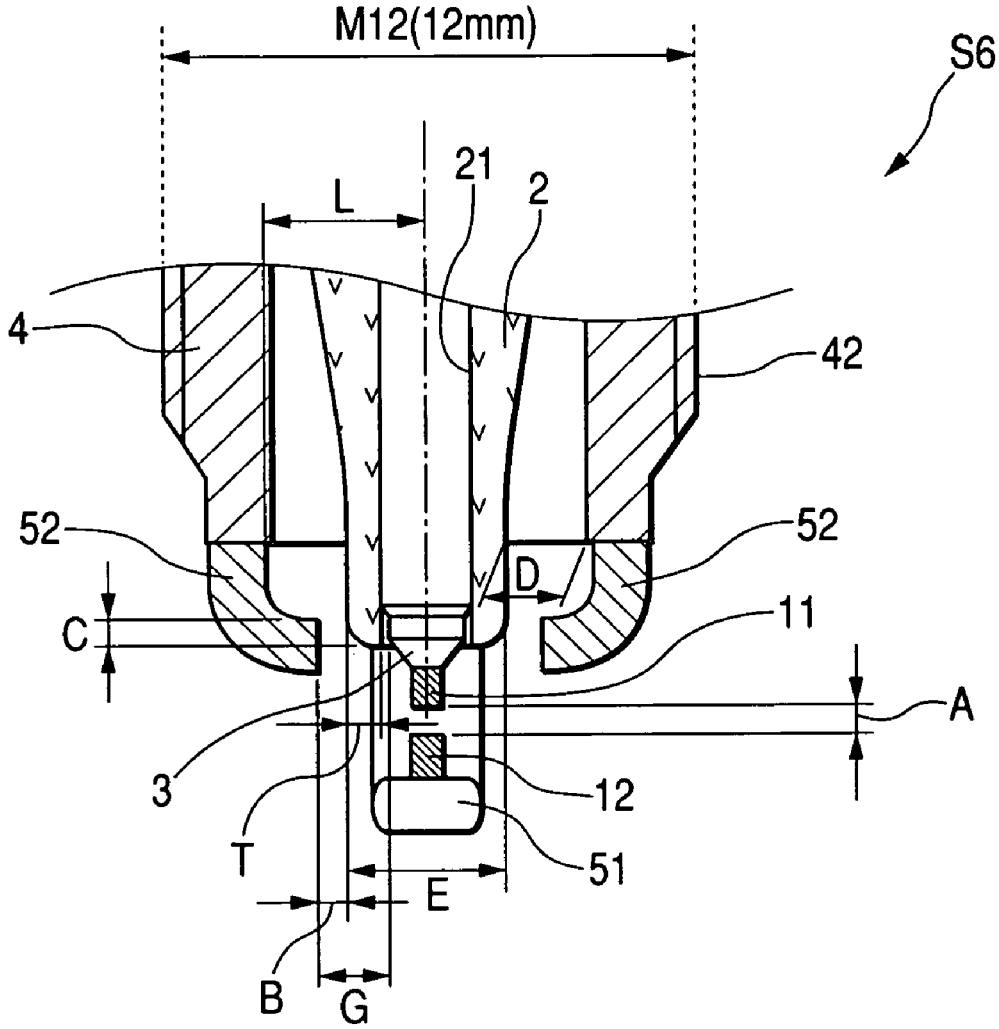
FIGS. 31 and 32 are enlarged partially cross-sectional side views showing an end portion of a spark plug according to the sixth embodiment of the invention.
Figure 32:
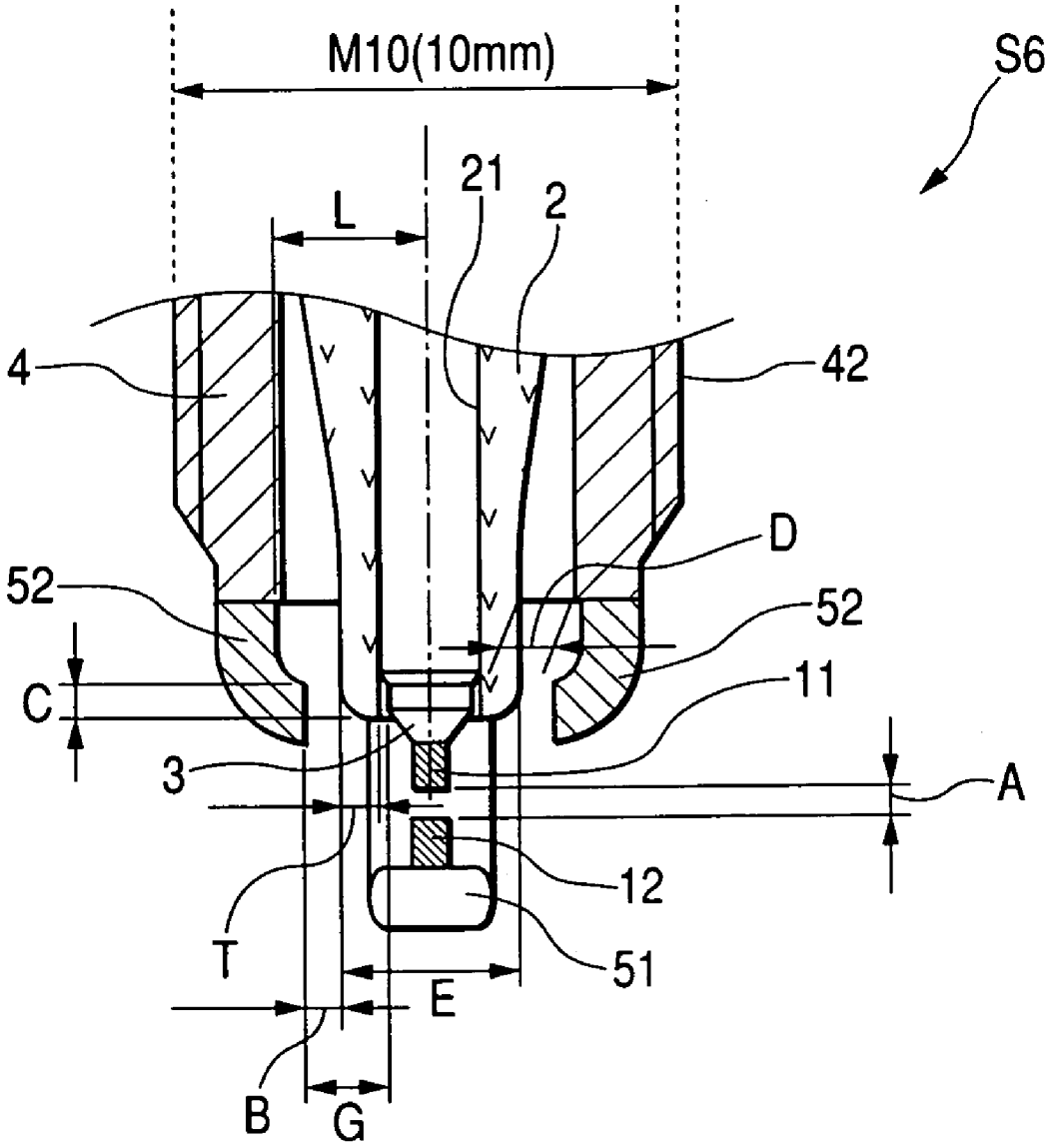

Specifically, in the spark plug S6, the threaded portion 42 of the metal shell 4 has a size of M12 or M10 as shown in FIGS. 31 and 32.

With the reduced size of the threaded portion 42, other dimensional parameters, such as the wall thickness T of the insulator 2, the distance L, the distance D, and the end diameter E of the insulator 2, accordingly have smaller values in the ranges specified above.

Consequently, it becomes possible to make the spark plug S6 compact, thus providing increased flexibly in engine design. For example, the intake and exhaust valves for the engine can be made large, and a water jacket for cooling of the engine can be secured.

[Other Variations]

While the above particular embodiments of the invention have been shown and described, it will be understood by those who practice the invention and those skilled in the art that various modifications, changes, and improvements may be made to the invention without departing from the spirit of the disclosed concept.

Figure 33:
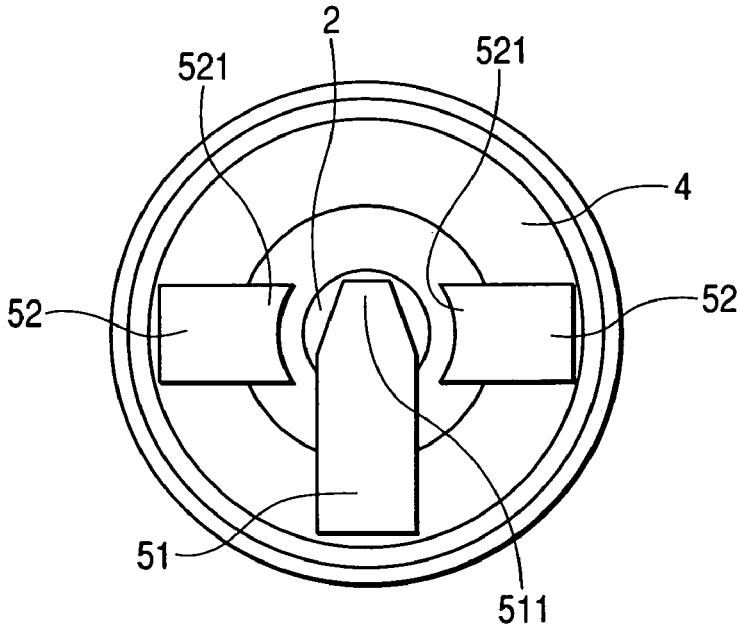
FIGS. 33–35 are end views illustrating possible variations of ground electrodes in spark plugs according to the invention.
Figure 34:
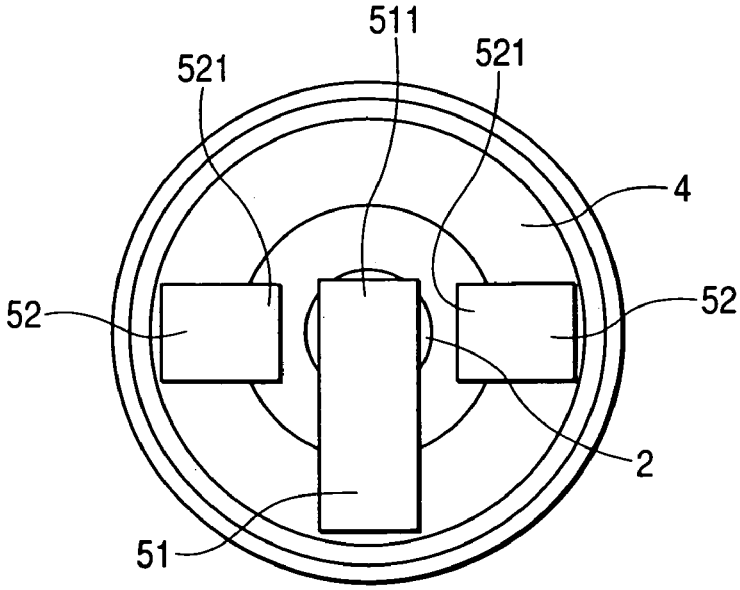
Figure 35:
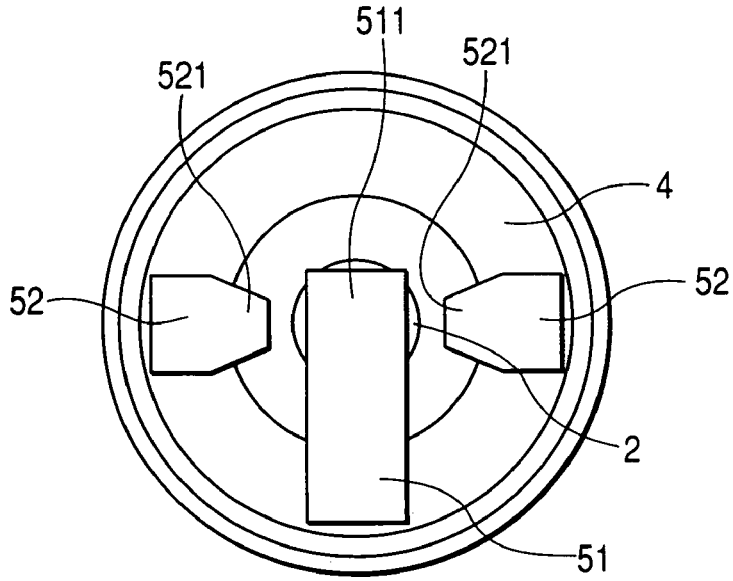
Figure 36:
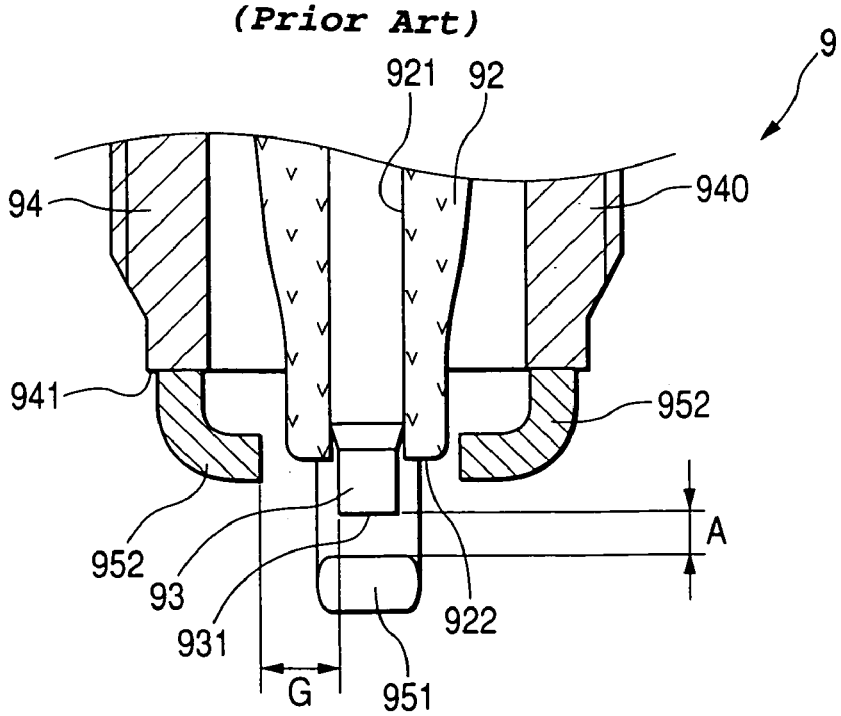
FIG. 36 (Prior Art)
FIG. 36 is an enlarged partially cross-sectional side view showing an end portion of a prior art spark plug.

For example, FIGS. 33–35 illustrate variations of the first ground electrode 51 and second ground electrodes 52.

In FIG. 33, when viewed along the axial direction of the center electrode 3, the tip potion 511 of the first ground electrode 51 tapers inwardly.

In FIG. 34, the tip portion 521 of each of the second ground electrodes 52 has a flat end surface that faces the center electrode 3.

In FIG. 35, when viewed along the axial direction of the center electrode 3, the tip portion 521 of each of the second ground electrodes 52 tapers inwardly.

Further, in the previous embodiments, the number of second ground electrodes 52 is two; however, only one or more than two second ground electrodes 52 may also be employed.

Additionally, in the experiments described above, only three engines of different types were used; however, the same tendency and similar results may be observed with other types of engines.

Such modifications, changes, and improvements within the skill of the art are intended to be covered by the appended claims.

What is claimed is:

1. A spark plug comprising:

a tubular metal shell having a threaded portion on an outer periphery thereof, the threaded portion having a size less than or equal to M14;

an insulator fixed in said metal shell, said insulator having a bore formed therethrough and an end that protrudes from an end of said metal shell;

a cylindrical center electrode secured in the bore of said insulator, said center electrode having an axis and an end that protrudes from the end of said insulator;

a first ground electrode having a base end joined to the end of said metal shell and a tip portion that faces the end of said center electrode through a first spark gap in an axial direction of said center electrode; and a second ground electrode having a base end joined to the end of said metal shell and a tip portion that faces an outer side surface of said center electrode through a second spark gap in a radial direction of said center electrode, wherein a size A of the first spark gap, which is a minimum distance between the end of said center electrode and the tip portion of said first ground electrode in the axial direction of said center electrode, is in a range of 0.4 to 1.0 mm;

a wall thickness T of said insulator at the end of said insulator is in a range of 0.3 to 0.8 mm;

a distance B, which is a minimum distance between said insulator and the tip portion of said second ground electrode, is in a range of 0.2 to 0.9 mm; and a distance C, which is a distance between an edge of the tip portion of said second ground electrode and the inner edge of the end of said insulator in the axial direction of said center electrode, is in a range of −1.0 to 0.5 mm, the edge of the tip portion of said second ground electrode facing the end of said metal shell, the distance C taking a positive value when the edge of the tip portion of said second ground electrode is closer to the end of said center electrode than the inner edge of the end of said insulator in the axial direction of said center electrode, wherein said second ground electrode comprises a base member and a discharge member, the discharge member is made of one of a noble metal and an alloy of the noble metal; and the discharge member has a length with a first end facing the outer side surface of said center electrode in the radial direction of said center electrode and a second end joined to the base member.

2. The spark plug as set forth in claim 1, wherein the distance B is in a range of 0.2 mm to (A−0.05 mm).

3. The spark plug as set forth in claim 1, wherein a distance D, which is a distance between an inner edge of the end of said metal shell and an outer surface of said insulator in the radial direction of said center electrode, is in a range of 0.6 to 1.6 mm.

4. The spark plug as set forth in claim 1, wherein an outer diameter E of said insulator at the end of said insulator is in a range of 2.1 to 3.9 mm.

5. The spark plug as set forth in claim 1, wherein a cross sectional area of the discharge member, which is perpendicular to a lengthwise direction of the discharge member, is in a range of 0.1 to 0.8 $mm^2$; and a distance from the first end of the discharge member to the base member in the lengthwise direction of the discharge member is in a rang of 0.3 to 1.5 mm.

6. The spark plug as set forth in claim 1, wherein the discharge member is made of a Pt-based alloy that includes Pt in an amount of not less than 50 weight percent and at least one additive selected from Ir, Rh, Ni, W, Pd, Ru, Os, Y, and $Y_2O_3$.

7. The spark plug as set forth in claim 1, wherein the discharge member is made of an Ir-based alloy that includes Ir in an amount of not less than 50 weight percent and at least one additive selected from Pt, Rh, Ni, W, Pd, Ru, Os, Y, and $Y_2O_3$.

8. The spark plug as set forth in claim 1, wherein said center electrode comprises a base member and a discharge member, the discharge member having a length with a first end representing the end of said center electrode and a second end joined to the base member, and wherein a cross sectional area of the discharge member, which is perpendicular to a lengthwise direction of the discharge member, is in a range of 0.1 to 0.8 $mm^2$; and a distance from the first end of the discharge member to the base member in the lengthwise direction of the discharge member is in a rang of 0.3 to 1.5 mm.

9. The spark plug as set forth in claim 1, wherein said first ground electrode comprises a base member and a discharge member, the discharge member having a length with a first end facing the end of said center electrode in the axial direction of said center electrode and a second end joined to the base member, and wherein a cross sectional area of the discharge member, which is perpendicular to a lengthwise direction of the discharge member, is in a range of 0.1 to 0.8 $mm^2$; and a distance from the first end of the discharge member to the base member in the lengthwise direction of the discharge member is in a rang of 0.3 to 1.5 mm.

10. The spark plug as set forth in claim 1, wherein the threaded portion of said metal shell has a size less than or equal to M12.

11. The spark plug as set forth in claim 10, wherein the threaded portion of said metal shell has a size less than or equal to M10.

12. A spark plug comprising:

a tubular metal shell having a threaded portion on an outer periphery thereof, the threaded portion having a size less than or equal to M14;

an insulator fixed in said metal shell, said insulator having a bore formed therethrough and an end that protrudes from an end of said metal shell;

a cylindrical center electrode secured in the bore of said insulator, said center electrode having an axis and an end that protrudes from the end of said insulator;

a first ground electrode having a base end joined to the end of said metal shell and a tip portion that faces the end of said center electrode through a first spark gap in an axial direction of said center electrode; and a second ground electrode having a base end joined to the end of said metal shell and a tip portion that faces an outer side surface of said center electrode through a second spark gap in a radial direction of said center electrode, wherein a distance L, which is a distance between an inner edge of the base end of said second ground electrode and the axis of said center electrode in the radial direction of said center electrode, is less than or equal to 3.5 mm;

a wall thickness T of said insulator at the end of said insulator is in a range of 0.3 to 0.8 mm;

a distance B, which is a minimum distance between said insulator and the tip portion of said second ground electrode, is in a range of 0.2 to 0.9 mm; and a distance C, which is a distance between an edge of the tip portion of said second ground electrode and the inner edge of the end of said insulator in the axial direction of said center electrode, is in a range of −1.0 to 0.5 mm, the edge of the tip portion of said second ground electrode facing the end of said metal shell, the distance C taking a positive value when the edge of the tip portion of said second ground electrode is closer to the end of said center electrode than the inner edge of the end of said insulator in the axial direction of said center electrode.

13. The spark plug as set forth in claim 12, wherein an outer diameter E of said insulator at the end of said insulator is in a range of 2.1 to 3.9 mm.

14. The spark plug as set forth in claim 12, wherein a size A of the first spark gap, which is a minimum distance between the end of said center electrode and the tip portion of said first ground electrode in the axial direction of said center electrode, is in a range of 0.4 to 1.1 mm.

15. The spark plug as set forth in claim 12, wherein a distance D, which is a distance between an inner edge of the end of said metal shell and an outer surface of said insulator in the radial direction of said center electrode, is in a range of 0.6 to 1.6 mm.

16. The spark plug as set forth in claim 12, wherein at least one of said center electrode, said first ground electrode, and said second ground electrode comprises a base member and a discharge member that is joined to the base member, and wherein the discharge member is made of one of a noble metal and an alloy of the noble metal.

17. The spark plug as set forth in claim 16, wherein the discharge member is made of a Pt-based alloy that includes Pt in an amount of not less than 50 weight percent and at least one additive selected from Jr, Rh, Ni, W, Pd, Ru, Os, Y, and $Y_2O_3$.

18. The spark plug as set forth in claim 16, wherein the discharge member is made of an Ir-based alloy that includes Ir in an amount of not less than 50 weight percent and at least one additive selected from Pt, Rh, Ni, W, Pd, Ru, Os, Y, and $Y_2O_3$.

19. The spark plug as set forth in claim 16, wherein said center electrode comprises a base member and a discharge member, the discharge member having a length with a first end representing the end of said center electrode and a second end joined to the base member, and wherein a cross sectional area of the discharge member, which is perpendicular to a lengthwise direction of the discharge member, is in a range of 0.1 to 0.8 $mm^2$; and a distance from the first end of the discharge member to the base member in the lengthwise direction of the discharge member is in a rang of 0.3 to 1.5 mm.

20. The spark plug as set forth in claim 16, wherein said first ground electrode comprises a base member and a discharge member, the discharge member having a length with a first end facing the end of said center electrode in the axial direction of said center electrode and a second end joined to the base member, and wherein a cross sectional area of the discharge member, which is perpendicular to a lengthwise direction of the discharge member, is in a range of 0.1 to 0.8 $mm^2$; and a distance from the first end of the discharge member to the base member in the lengthwise direction of the discharge member is in a rang of 0.3 to 1.5 mm.

21. The spark plug as set forth in claim 16, wherein said second ground electrode comprises a base member and a discharge member, the discharge member having a length with a first end facing the outer side surface of said center electrode in the radial direction of said center electrode and a second end joined to the base member, and wherein a cross sectional area of the discharge member, which is perpendicular to a lengthwise direction of the discharge member, is in a range of 0.1 to 0.8 $mm^2$; and a distance from the first end of the discharge member to the base member in the lengthwise direction of the discharge member is in a rang of 0.3 to 1.5 mm.

22. The spark plug as set forth in claim 12, wherein the threaded portion of said metal shell has a size less than or equal to M12.

23. The spark plug as set forth in claim 22, wherein the threaded portion of said metal shell has a size less than or equal to M10.

* * * * *